US006676710B2

(12) United States Patent
Smith et al.

(10) Patent No.: US 6,676,710 B2
(45) Date of Patent: Jan. 13, 2004

(54) PROCESS FOR TREATING TEXTILE SUBSTRATES

(75) Inventors: Carl Brent Smith, Raleigh, NC (US); Walter A. Hendrix, Raleigh, NC (US); Donald L. Butcher, Knightdale, NC (US)

(73) Assignee: North Carolina State University, Raleigh, NC (US)

( * ) Notice: Subject to any disclaimer, the term of this patent is extended or adjusted under 35 U.S.C. 154(b) by 25 days.

(21) Appl. No.: 09/729,566

(22) Filed: Dec. 4, 2000

(65) Prior Publication Data

US 2002/0108183 A1 Aug. 15, 2002

Related U.S. Application Data

(60) Provisional application No. 60/241,262, filed on Oct. 18, 2000.

(51) Int. Cl.[7] ..... D06M 1/02; D06O 1/02

(52) U.S. Cl. ..... 8/115.51; 8/115.6; 8/116.1; 8/107; 8/137; 8/139; 8/142; 8/404; 8/474; 8/475; 8/495; 8/916; 134/42

(58) Field of Search ..... 8/107, 137, 139, 8/142, 404, 474, 475, 495, 916, 115.6, 116.1, 115.51; 134/42

(56) References Cited

U.S. PATENT DOCUMENTS

| | | | |
|---|---|---|---|
| 3,921,420 | A | 11/1975 | Aurich et al. |
| 3,949,575 | A | 4/1976 | Turner et al. |
| 3,987,138 | A | 10/1976 | Hege |
| 4,012,194 | A | 3/1977 | Maffei |
| 4,464,172 | A | 8/1984 | Lichtenstein |
| 4,478,720 | A | 10/1984 | Perrut |
| 4,483,032 | A | 11/1984 | Christ et al. |
| 4,502,488 | A | 3/1985 | Degironimo et al. |
| 4,806,171 | A | 2/1989 | Whitlock et al. |
| 4,862,546 | A | 9/1989 | von der Eltz et al. |
| 4,923,720 | A | 5/1990 | Lee et al. |
| 4,925,444 | A | 5/1990 | Orkin et al. |
| 4,943,403 | A | 7/1990 | Miyashita et al. |
| 4,984,317 | A | 1/1991 | Christ |
| 5,027,742 | A | 7/1991 | Lee et al. |

(List continued on next page.)

FOREIGN PATENT DOCUMENTS

| | | |
|---|---|---|
| DE | 3904513 A1 | 8/1990 |
| DE | 3906724 A1 | 9/1990 |
| DE | 3906735 A1 | 9/1990 |

(List continued on next page.)

OTHER PUBLICATIONS

Then Maschinen– UNC Apparatebau GMBH, "Then–Airflow AFS," Then Mashinen–und Apparatebau GmbH (Germany).

Achwal, "Dyeing in Supercritical Carbon Dioxide: Quantum Jump from Ecological Point of View," Colourage, pp. 23–25, (1993).

Atkins, "Physical Chemistry, 5th ed.," W.H. Freeman and Company (New York), pp. 43–44, (1994).

(List continued on next page.)

*Primary Examiner*—Yogendra N. Gupta
*Assistant Examiner*—Derrick G Hamlin
(74) *Attorney, Agent, or Firm*—Jenkins, Wilson & Taylor, P.A.

(57) ABSTRACT

A process for treating a textile substrate, the process including the steps of providing a textile substrate; providing a treatment bath; entraining a transport material in the treatment bath wherein the transport material further comprises a treatment material dissolved or suspended therein and wherein the transport material is substantially immiscible with the treatment bath; and contacting the textile substrate with the transport material in the treatment bath to thereby treat the textile substrate with the treatment material in the transport material.

44 Claims, 8 Drawing Sheets

U.S. PATENT DOCUMENTS

| | | | |
|---|---|---|---|
| 5,105,843 | A | 4/1992 | Condron et al. |
| 5,169,433 | A | 12/1992 | Lindsay et al. |
| 5,171,613 | A | 12/1992 | Bok et al. |
| 5,172,443 | A | 12/1992 | Christ |
| 5,198,197 | A | 3/1993 | Clay et al. |
| 5,199,956 | A | 4/1993 | Schlenker et al. |
| 5,203,843 | A | 4/1993 | Hoy et al. |
| 5,212,229 | A | 5/1993 | Taylor et al. |
| 5,233,021 | A | 8/1993 | Sikorski |
| 5,233,072 | A | 8/1993 | Kricsfalussy et al. |
| 5,236,602 | A | 8/1993 | Jackson |
| 5,250,078 | A | 10/1993 | Saus et al. |
| 5,267,455 | A | 12/1993 | Dewees et al. |
| 5,268,102 | A | 12/1993 | Clay et al. |
| 5,269,815 | A | 12/1993 | Schlenker et al. |
| 5,279,615 | A | 1/1994 | Mitchell et al. |
| 5,298,032 | A | 3/1994 | Schlenker et al. |
| 5,306,350 | A | 4/1994 | Hoy et al. |
| 5,316,591 | A | 5/1994 | Chao et al. |
| 5,370,742 | A | 12/1994 | Mitchell et al. |
| 5,374,305 | A | 12/1994 | Glancy et al. |
| 5,412,958 | A | 5/1995 | Iliff et al. |
| 5,417,768 | A | 5/1995 | Smith, Jr. et al. |
| 5,431,843 | A | 7/1995 | Mitchell et al. |
| 5,443,796 | A | 8/1995 | Coeling et al. |
| 5,456,759 | A | 10/1995 | Stanford, Jr. et al. |
| 5,467,492 | A | 11/1995 | Chao et al. |
| 5,474,812 | A | 12/1995 | Truckenmuller et al. |
| 5,486,212 | A | 1/1996 | Mitchell et al. |
| 5,496,901 | A | 3/1996 | DeSimone |
| 5,509,431 | A | 4/1996 | Smith, Jr. et al. |
| 5,509,959 | A | 4/1996 | Nielsen et al. |
| 5,512,058 | A | 4/1996 | Gavend et al. |
| 5,512,231 | A | 4/1996 | Thies et al. |
| 5,526,834 | A | 6/1996 | Mielnik et al. |
| 5,578,088 | A | 11/1996 | Schrell et al. |
| 5,601,707 | A | 2/1997 | Clay et al. |
| 5,613,509 | A | 3/1997 | Kolb et al. |
| 5,618,894 | A | 4/1997 | DeSimone et al. |
| 5,651,276 | A | 7/1997 | Purer et al. |
| 5,669,251 | A | 9/1997 | Townsend et al. |
| 5,676,705 | A | 10/1997 | Jureller et al. |
| 5,938,794 | A | 8/1999 | Eggers et al. |
| 5,953,780 | A | 9/1999 | Schollmeyer et al. |
| 6,010,542 | A | 1/2000 | DeYoung et al. |
| 6,048,369 | A | 4/2000 | Smith et al. |
| 6,287,640 | B1 | 9/2001 | McClain et al. |
| 2001/0003604 | A1 | 6/2001 | McClain et al. |

FOREIGN PATENT DOCUMENTS

| | | | |
|---|---|---|---|
| DE | 4332219 | A1 | 3/1994 |
| DE | 4429470 | A1 | 3/1995 |
| DE | 4333221 | A1 | 4/1995 |
| DE | 4336941 | A1 | 5/1995 |
| DE | 4344021 | A1 | 6/1995 |
| DE | 4408784 | A1 | 9/1995 |
| DE | 198 13 477 | A1 | 10/1999 |
| EP | 022207 | A2 | 5/1987 |
| EP | 0 324 941 | | 7/1989 |
| EP | 0474598 | A1 | 3/1992 |
| EP | 0474599 | A1 | 3/1992 |
| EP | 0474600 | A1 | 3/1992 |
| EP | 0514337 | A1 | 11/1992 |
| EP | 0 945 538 | A1 | 9/1999 |
| EP | 1 126 072 | A3 | 2/2000 |
| EP | 1 126 072 | A2 | 8/2001 |
| JP | 8104830 | | 4/1996 |
| JP | 8113652 | | 5/1996 |
| SU | 883208 | | 11/1981 |
| WO | wo 93/14259 | | 7/1993 |
| WO | wo 94/09201 | | 4/1994 |
| WO | wo95/01221 | | 1/1995 |
| WO | wo96/00610 | | 1/1996 |
| WO | wo97/13915 | | 4/1997 |
| WO | WO97/14838 | | 4/1997 |
| WO | wo97/14843 | | 4/1997 |
| WO | WO97/33033 | | 9/1997 |
| WO | wo99/63146 | | 12/1999 |
| WO | WO01/04410 | | 1/2001 |

OTHER PUBLICATIONS

Bach et al., "Dyeig of Poly (Ethylene Terephthalate) Fibers in Supercritical Carbon Dioxide," Proceedings of the 3rd International Symposium on High–pressure Chemical Engineering, p. 581–586, (1996).

Bach et al., "Experience with the Uhde CO2–Dyeing Plant on Tehcnical Scale, Part 1: Optimization of the Pilot Plant and First Dyeing Results," Melliand Int., p. 165–168, (1999).

Bach et al., "Experience With the Uhde CO2–Dyeing Plant on Technical Scale, Part 2: Concept for the Development of the Pilot Plant in Respect of a Scaling Up of the Machine," Melliand Int., p. 192–194, (1998).

Bach et al., "The Dyeing of Polyolefin Fibers in Supercritical Carbon Dioxide, Part 1: Thermo–mechanical Properties of Polyolefin Fibers After Treatment in CO2 Under Dyeing Conditions," J. Text. Inst., vol. 89 (No. 4), p. 647–655, (1998).

Bach et al., "The Dyeing of Polyolefin Fibers in Supercritical Carbon Dioxide, Part 2: The Influence of Dye Structure on the Dyeing of Fabrics and on Fastness Properties," J. Text. Inst., vol. 89 (No. 4), p. 657–668, (1998).

Bach et al., "Treatment of Textile Fibers in Dense Gases–An Overview," Proceedings of the Fifth International Symposium on Supercritical Fluids, (Apr. 8, 2000).

Bach et al., "Correlation of Solubility Data of disperse Dyes with the Dye Uptake of Poly (Ethylene Terephthalate) Fibers (PETP) in Supercritical Carbon Dioxide," Fifth Conference on Supercritical Fluids and Their Applications, p. 427, (Jun. 13, 1999).

Bach et al., "Dyeing of Synthetic Fibers in Supercritical Carbon Dioxide," Proceedings of the Fifth Meeting on Supercritical Fluids, p. 345, (1998).

Bartle et al., "Solubilities of Solids and Liquids of Low Volatility in Supercritical Carbon Dioxide," J. Phys. Chem. Ref. Data, vol. 20 (No. 4), p. 713–756, (1991).

Basf, "Dyeing and Finishing of Polyester Fibres," BASF Manual for Polyester Fibres, pp. 21–30.

Bork, "Supercritical Fluid Dyeing of Synthetic Fibers," Proceedings of the Fifth Meeting on Supercritical Fludis, p. 387, (1998).

Burk et al., "Solubilities of Solids in Supercritical Fluids," The Canadian Journal of Chemical Engineering, vol. 70, pp. 403–407, (Apr. 1992).

Chang et al., "Dyeing of PET Fibers and Films in Supercritical Carbon Dioxide," Korean Journal of Chemical Engineering, vol. 13 (No. 3), p. 310–316, (1996).

Degiorgi et al., "Dyeing Polyester Fibers with Disperse Dyeing in Supercritical CO2," Proceedings of the Fifth Meeting on Supercritical Fluids, p. 393, (1998).

Dobbs et al., "Modification of Supercritical Fluid Phase Behavior Using Polar Cosolvents," Ind. Eng. Chem. Res., vol. 26 (No. 1), pp. 56–65, (1987).

Dobbs et al., "Selectivities in Pure and Mixed Supercritical Fluid Solvents," Ind. Eng. Chem. Res., vol. 26, pp. 1476–1482, (1987).
Draper et al., "Solubility Relationship for Disperse Dyes in Supercritical Carbon Dioxide," Dyes and Pigments, p. 177–183, (2000).
Drews et al., "An Investigation of the Effects of Temperature and Pressure Ramping on Shade in the Stock Dyeing of PET with Supercritical CO2, Part I: Dyeing at Constant T&P," AATCC Book of Papers, pp. 360–368, (1996).
Gupta et al., "Solvent Effect on Hydrogen Bonding in Supercritical Fluids," J. Phys. Chem., vol. 97, pp. 707–715, (1993).
Haarhaus et al., "High–Pressure Investigations on the Solubility of Dispersion Dyestuffs in Supercritical Gases by VIS/NIR–Spectroscopy. Part I–1, 4–Bis–(octadecylamino)–9,10–anthraquinone and Disperse Orange in CO2 and N2O up to 180 MPa," The Journal Supercritical Fluids, pp. 100–106, (1995).
Holme, "New Dyes for Supercritical Fluid Dyeing," Int. Dyer, p. 27, 30, (May, 1999).
Holme, "Latest Developments in Dyes and Finishes for Man–Made Fibres," International Dryer , pp. 13–17, (1993).
Knittel et al., "Dyeing Without Water," Book of Papers, AATCC International Conference & Exhibition, p. 86, (1995).
Knittel et al., "Dyeing from Supercritical CO2–Fastness of Dyeing," Melliand English, vol. 75 (No. 5), p. E99, (May, 1994).
Knittel et al., "Application of Supercritical Carbon Dioxide in Finishing Processes," J. Text Inst., vol. 84 (No. 4), pp. 534–552, (1993).
Kramrisch, "Dyeing Technical Fibres in Supercritical Carbon Dioxide," International Dyer, p. 12, (Aug. 1992).
Montero et al., "Supercritical Fluid Technology in Textile Processing," Proceedings of the Fifth International Symposium on Supercritical Fluids, (Apr. 8, 2000).
Montero et al., "Supercritical Fluid Extraction of Contaminated Soil ," J. Environ. Sci. Health, vol. A32 (No. 2), pp. 481–495, (1997).
Phelps et al. , "Past, Present, and Possible Future Applications of Supercritical Fluid Extraction Technology," Journal of Chemical Education, vol. 73 (No. 12), pp. 1163–1168, (Dec. 1996).
Poulakis et al., "Dyeing of Polyester in Supercritical CO2," Chemiefasern/Textilindustrie, vol. 93 (No. 41), pp. 142–147, (Feb. 1991).
Saus et al., "Dyeing with Supercritical Carbon Dioxide–An Alternative to High Temperature Dyeing of Polyester," Textil–praxis International (Foreign Edition), pp. 1052–1054, (Nov. 1992).
Saus et al., "Dyeing with Supercritical Carbon Dioxide–Physico–Chemical Fundamentals," Textil–praxis International (Foreign Edition), p. 32–36, (Jan. 1993).
Saus et al. , "Dyeing of Textiles in Supercritical Carbon Dioxide," Textile Res. J., vol. 63 (No. 3), pp. 135–142, (1993).
Saus et al., "Water–Free Dyeing of Synthetic Material–Dyeing in Supercritical CO2," International Textile Bulletin. Dyeing/Printing/Finishing, pp. 20–22, (1993).
Scheibli et al., "Dyeing in Supercritical Carbon Dioxide–An Environmental Quantum Leap in Textile Processing," Chemiefasern/Textilindustrie, vol. 43 (No. 95), pp. E64–E65, (1994).
Schnitzler et al., "Mass trasfer Phenomena in Polymers During Treatment in a Supercritica CO2–Atmosphere," Proceedings of the Fifth Meeting on Supercritical Fluids, p. 93, (1998).

Shannon, "Development and Evaluation of a Darcy Flow Model for Supercritical Fluid Flow Through Polyester Yarn Packages," M.S. Thesis, College of Textiles, North Carolina State University (Raleigh, North Carolina), (1999).

Shannon et al., "Modeling of Supercritical Fluid Flow Through a Yarn Package," Fifth Conference on Supercritical Fluids and Their Application, p. 419, (Jun. 13, 1999).

Shim et al., "Polymer Sorption of Disperse Dyes in Supercritical Carbon Dioxide," Proceedings of the Fifth International Symposium on Supercritical Fluids, (Apr. 8, 2000).

Sicardi et al., "Dye Diffusion in PET Films in the Presence of a Supercritical or Aqueous Solvent," Proceedings of the Fifth International Symposium on Supercritical Fluids, (Apr. 8, 2000).

Sicardi et al, "Influence of Disperse Dyes in PET Films During Impregnation With Supercritical CO2," Fifth Conference on Supercritical Fluids and Their Applications, P. 467, (Jun. 13, 1999).

Sicardi et al., "Hydrodynamics of Supercritical CO2 Flow Through a Spool of Polyester Yarn," Proceedings of Fifth Meeting of Supercritical Fluids, 5th ed., p. 193, (1998).

Skoog et al., "Principles of Instrumental Analysis," Saunders College Publishing (Fort Worth), pp. 124–126, (1992).

Swidersky et al., "High–Pressure Investigations on the Solubility of Anthraquinone Dyestuffs in Supercritical Gases by VIS–Spectroscopy. Part II–1, 4–Bis–(n–alkylamino)–9, 10–anthraquinones and Disperse Red II in CO2, N2O, CHF3 up to 180 MPa," The Journal of Supercritical Fluids, vol. 9 (No. 1), pp. 12–18, (1996).

Tavana et al., "Scanning of Cosolvents for Supercritical fluids Solubilization of Organics," AIChE Journal, vol. 35 (No. 4), pp. 645–648, (Apr. 1989).

Tessari et al., "Impregnation of Polyester Fibers in Supercritical Carbon Dioxide," Fifth conference on Supercritical Fluids and Their Applications, p. 441, (Jun. 13, 1999).

U.S. Environmental Protection Agency, "Best Management Practices for Pollution Prevention in the Textile Industry," pp. 21–22, (Sep. 1996).

Wenclawiak (ED.), "Analysis with Supercritical Fluids: Extraction and Chromatography," pp. 1–3.

Wharton, "Ultraviolet Absorbers in Near Critical and Supercritical Carbon Dioxide," M.S. Thesis, College of Textiles, North Carolina State University (Raleigh, North Carolina), (1999).

Drews et al., "The Effect of Supercritical CO2 Dyeing Conditions on the Morphology of Polyester Fibers," Text, Chemical and Colorist, vol. 30 (No. 6), p. pp. 13–20, (1998).

PROCESS FOR TREATING TEXTILE SUBSTRATES

CROSS REFERENCE TO RELATED APPLICATIONS

This application is based on and claims priority to U.S. provisional patent application serial no. 60/241,262 filed Oct. 18, 2000, herein incorporated by reference in its entirety.

TECHNICAL FIELD

The present invention relates generally a process for treating textile substrates, and more particularly to a process for treating a textile substrate in treatment bath having a transport material entrained therein, the transport material having a treatment material dissolved, dispersed or suspended therein. In a preferred embodiment, the process comprises treating a textile substrate in supercritical fluid carbon dioxide (SCF—$CO_2$).

BACKGROUND ART

It will be appreciated by those having ordinary skill in the art that conventional aqueous dyeing processes for textile substrates generally provide for effective dyeing, but possess many economic and environmental drawbacks. Particularly, aqueous dye baths that include organic dyes and co-solvents must be disposed of according to arduous environmental standards. Compliance with environmental regulations and process heating requirements thus drive up the costs of aqueous textile dyeing to both industry and the consuming public alike. Accordingly, there is a substantial need in the art for an alternative dyeing process wherein such problems are avoided.

One alternative to aqueous dyeing that has been proposed in the art is the dyeing of textile substrates in a supercritical fluid. Particularly, textile dyeing processes using supercritical fluid carbon dioxide (SCF—$CO_2$) have been explored.

However, those in the art who have attempted to treat textile substrates in SCF—$CO_2$ have encountered a variety of problems. These problems include, but are not limited to, "crocking" (i.e. tendency of a dye to smudge when a dyed article is touched) of a dye on a dyed textile article; unwanted deposition of the dye onto the article and/or onto the dyeing apparatus during process termination; difficulty in characterizing solubility of the dyes in SCF—$CO_2$; insolubility of many dyes and other treatment materials in $CO_2$; difficulty introducing the dyes into the SCF—$CO_2$ flow; difficulty in preparing the dyes for introduction into the dyeing process; high pressure and temperature requirements for solubility; and trimer (cyclic oligomer) extraction from polyester at high temperature. These problems are exacerbated when attempts to extrapolate from a laboratory process to a plant-suitable process are made.

Poulakis et al., *Chemiefasern/Textilindustrie*, Vol. 43–93, February 1991, pages 142–147 discuss the phase dynamics of supercritical carbon dioxide. An experimental section describing an apparatus and process for dyeing polyester in supercritical carbon dioxide in a laboratory setting is also presented. Thus, this reference only generally describes the dyeing of polyester with supercritical carbon dioxide in the laboratory setting and is therefore believed to be limited in practical application.

U.S. Pat. No. 5,199,956 issued to Schlenker et al. on Apr. 6, 1993 describes a process for dyeing hydrophobic textile substrate with disperse dyes by heating the disperse dyes and textile substrate in SCF—$CO_2$ with an azo dye having a variety of chemical structures. The patent thus attempts to provide an improved SCF—$CO_2$ dyeing process by providing a variety of dyes for use in such a process.

U.S. Pat. No. 5,250,078 issued to Saus et al. on Oct. 5, 1993 describes a process for dyeing hydrophobic textile substrate with disperse dyes by heating the disperse dyes and textile substrate in SCF—$CO_2$ under a pressure of 73 to 400 bar at a temperature in the range from 80° C. to 300° C. Then the pressure and temperature are lowered to below the critical pressure and the critical temperature, wherein the pressure reduction is carried out in a plurality of steps.

U.S. Pat. No. 5,578,088 issued to Schrell et al. on Nov. 26, 1996 describes a process for dyeing cellulose fibers or a mixture of cellulose and polyester fibers, wherein the fiber material is first modified by reacting the fibers with one or more compounds containing amino groups, with a fiber-reactive disperse dyestuff in SCF—$CO_2$ at a temperature of 70–210° C. and a $CO_2$ pressure of 30–400 bar. Specific examples of the compounds containing amino groups are also disclosed. Thus, this patent attempts to provide level and deep dyeings by chemically altering the fibers prior to dyeing in SCF—$CO_2$.

U.S. Pat. No. 5,298,032 issued to Schlenker et al. on Mar. 29, 1994 describes a process for dyeing cellulosic textile substrate, wherein the textile substrate is pretreated with an auxiliary composition that promotes dye uptake subsequent to dyeing, under pressure and at a temperature of at least 90° C. with a disperse dye from SCF—$CO_2$. The auxiliary composition is described as being preferably polyethylene glycol. Thus, this patent attempts to provide improved SCF—$CO_2$ dyeing by pretreating the material to be dyed.

Despite extensive research into SCF—$CO_2$ textile treatment processes, there remains room for improvement in the development of a process for treating a textile substrate with a textile treatment material. A process for treating a textile substrate would be particularly desirable in a plant-scale application of an SCF—$CO_2$ textile treatment process. Therefore, the development of such a process meets a long-felt and significant need in the art.

SUMMARY OF THE INVENTION

A process for treating a textile substrate is disclosed. The process comprises providing a textile substrate; providing a treatment bath; entraining a transport material in the treatment bath wherein the transport material further comprises a treatment material dissolved, dispersed or suspended therein and wherein the transport material is substantially immiscible with the treatment bath; and contacting the textile substrate with the transport material in the treatment bath to thereby treat the textile substrate with the treatment material in the transport material. In a preferred embodiment, the process comprises treating a textile substrate in supercritical fluid carbon dioxide (SCF—$CO_2$).

Accordingly, it is an object of the present invention to provide a novel process for treating a textile substrate. This object is achieved in whole or in part by the present invention.

An object of the invention having been stated hereinabove, other objects will be evident as the description proceeds, when taken in connection with the accompanying Drawings and Laboratory Examples as best described hereinbelow.

DETAILED DESCRIPTION OF THE INVENTION

Figure 1A:
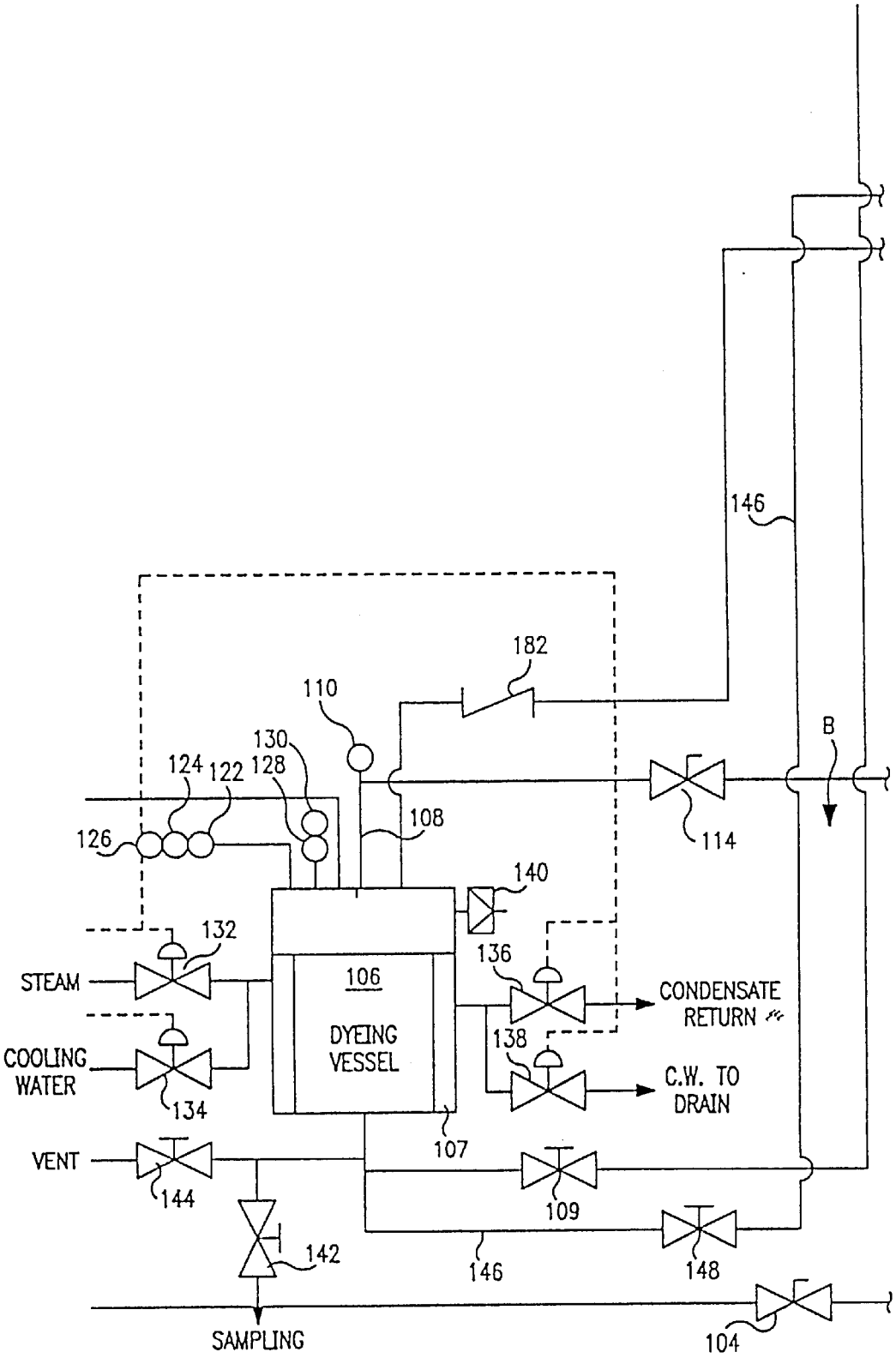
FIGS. 1A–1B is a detailed schematic of a system suitable for use in the textile treatment process of the present invention.

A process for treating a textile substrate is disclosed. The process comprises providing a textile substrate; providing a treatment bath; entraining a transport material in the treatment bath wherein the transport material further comprises a treatment material dissolved, dispersed or suspended therein and wherein the transport material is substantially immiscible with the treatment bath; and contacting the textile substrate with the transport material in the treatment bath to thereby treat the textile substrate with the treatment material in the transport material.

The process of the present invention can further comprise an optional drying step. Optionally, the drying step can be accomplished using a conventional apparatus or system, such as dielectric drying (radio-frequency or microwave), a centrifugal system or other thermal or mechanical/thermal system. Preferably, however, drying is accomplished by a process step, such as by circulating fresh treatment bath (i.e. having substantially no transport material entrained therein) through the textile substrate to remove excess transport material (e.g. water) present in the textile substrate. Optionally, bath temperature can be increased to enhance the drying step.

In a preferred embodiment, the transport material comprises water and the treatment bath comprises near-critical liquid $CO_2$ or SCF—$CO_2$. More preferably, the water is present in the near-critical liquid $CO_2$ or SCF—$CO_2$ treatment bath in a trace amount. Thus, a major advantage of a preferred embodiment of the present inventive process is that it eliminates virtually all water usage and attendant waste treatment required in conventional textile dyeing processes. The process also has great advantage in that the present inventive process can easily apply dyes of very low affinity, normally not suitable for batch/exhaust dyeing.

I. Process of the Present Invention

In the process of the present invention, the treatment bath can comprise any fluid that is (1) inert with respect to the dye, transport material and textile substrate and (2) has physical properties (density, viscosity, etc.) sufficient to entrain and transport finely distributed droplets or agglomerations of dye- or chemical-laden transport material. Near-critical liquid $CO_2$ or SCF—$CO_2$ represent preferred embodiments of such a fluid that is safe, economical and environmentally acceptable. Nitrogen, hexane and propane are additional examples. High-density fluids are preferred.

By the term "high-density" (for the non-aqueous bath liquid) it is meant sufficient to entrain, propel and inhibit settling of the droplets of transport material. The required magnitude of the density of the bath liquid can depend on the velocity of the bath liquid; the viscosity of the bath liquid; the density of the entrained transport material droplets; the size of the entrained transport material droplets; the design of the treatment machine; and on combinations of any of these characteristics.

In a preferred embodiment, the process uses small amounts (trace amounts) of a transport material that is substantially immiscible in the treatment bath. By the term "substantially immiscible" it is meant that the transport material and the treatment bath do not mix to form a solution, i.e., they are substantially insoluble in each other and usually exist in separate phases when mixed. Representative combinations thus included hydrophobic and hydrophilic materials, polar and non-polar materials and/or aqueous and non-aqueous materials. For example, the transport material can comprise an aqueous material (e.g., water), while the treatment bath comprises a non-aqueous material (e.g., SCF—$CO_2$).

Additionally, the term "transport material" is meant to refer to a material that (1) acts as a solvent, as a dispersing agent or as a suspending agent for the dye or other treatment materials; (2) is capable of wetting the textile substrate; and (3) is a liquid under the treatment conditions. Table 1 contrasts the action of conventional carriers that are used in conventional dyeing processes with that of a transport material of the present invention.

TABLE 1

Carrier vs. Transport Material

| Feature | Carrier | Transport Material |
|---|---|---|
| Entrainment | Emulsion of oil-type material in water. Carriers are substantially non-functional in SCF-$CO_2$. Neither the carrier-active material (e.g. 1,2,4 trichlorobenzene (TCB)), nor the emulsifier systems (e.g. ethoxylated nonyl phenol) are suitable for SCF-$CO_2$ use. | Entrained droplets of water-type material in SCF-$CO_2$. No emulsifier is involved. The treatment bath is not an emulsion; rather, the treatment bath comprises entrained droplets. |
| Dye interaction | Carriers do not dissolve non-ionic dyes within the emulsified droplets. | Treatment material (e.g. dye) is dissolved, dispersed or suspended in the entrained droplets; however, the treatment material is sparingly soluble in the SCF-$CO_2$. |
| Persistence | Carriers produce persistent effects in fibers. For example, polyester can be treated with carrier (1,2,4 TCB) then washed thoroughly so that no trace of the carrier remains. Then the fiber can be dyed and will respond as if carrier were still present in the bath. | Once removed, the transport material (e.g. aqueous transport material) preferably has no permanent effect. |
| Glass transition of fibers | Carriers reduce the glass transition temperature of fibers, and produce permanent morphological changes. | Cotton and wool have no glass transition temperature. They decompose upon heating (or burns)-they do not melt or undergo a glass transition. |

TABLE 1-continued

| Carrier vs. Transport Material | | |
|---|---|---|
| Feature | Carrier | Transport Material |
| | | Therefore, carriers would have no function with respect to cotton, wool, silk or similar fibers |
| Action | Carriers act in the fiber. A polyester fiber placed in a dye bath containing fiber will absorb essentially all of the carrier-active material. The action of the carrier is done by the absorbed material in the fiber. | The transport material acts in the bath to deliver the treatment material to the textile substrate as entrainment of material-laden droplets. |
| Continuous phase | The continuous phase is aqueous, i.e. a conventional aqueous treatment (e.g. dyeing) bath. | The continuous phase is preferably non-aqueous. |

A preferred transport material comprises water or comprises an aqueous solution, an aqueous dispersion, an aqueous emulsification, and/or an aqueous suspension, such as: water/alcohol, water/reducing or oxidizing agent, water/buffer (for pH control), water/salt, or water/surfactant, wherein the surfactant is soluble in water and preferably not soluble in SCF—$CO_2$. Though less preferred, other transport materials include, but are not limited to: alcohols, polyalcohols, fluorocarbons, chlorocarbons, hydrocarbons, amines, esters and amides.

Any dyes, chemicals or other textile treatment materials can be used in the process of the present invention so long as the dyes or chemicals are (1) soluble in the transport material and (2) capable of dyeing or treating the textile substrate. An example is the use of direct dyes to dye cotton in SCF—$CO_2$ with water as the transport material. Another example is the dyeing of wool in SCF—$CO_2$ with acid dyes, using water as the transport material. The transport material can be conveniently introduced by using it to prewet the textile substrate, but can also be introduced by injection into the treatment bath, along with or separately from the dye or treatment chemical, at a preferred point in the process, i.e., with respect to location and time.

Dyes that can be used to carry out the present invention include, but are not limited to, acid, basic, azo (mono, di, poly), carbonyl, sulfur, methine, and triarylcarbonium dyes. The dyes can be anionic (acid including non-metallized acid, mordant, direct, reactive), cationic (brilliant color with good color fastness), direct (substantive character without mordants), dispersive (very low solubility in dyebath, substantive toward hydrophobics), and azoid (azo containing small molecule permeation followed by a reaction to form a larger substantive dye) dyes.

Materials that can be dyed by the process of the present invention include, but are not limited to, fiber, yarns and fabrics formed from polyester, nylon, acrylic fibers, acetate (particularly cellulose acetate), triacetate, silk, rayon, cotton and wool, including blends thereof such as cotton/polyester blends, as well as leather. In particular, textile substrates are treated by the process, and encompass a large number of materials. Such substrates are those formed from textile fibers and precursors and include, for example, fabrics, garments, upholstery, carpets, tents, canvas, leather, clean room suits, parachutes, yarns, fibers, threads, footwear, silks, and the other water sensitive fabrics. Articles (e.g., ties, dresses, blouses, shirts, and the like) formed of silk or acetate can also be treated via the process of the present invention.

In one embodiment, the process of the present invention pertains to the treatment of hydrophilic fibers, including natural fibers (e.g., cotton, wool and silk) in a non-aqueous fluid treatment bath (e.g., supercritical fluid carbon dioxide, SCF—$CO_2$) with textile dyes and other textile treatment materials. The treatment is accomplished by entraining dye- or chemical-laden transport materials in an inert treatment bath in a manner that delivers the dye- or chemical-laden transport materials to the textile substrate to be dyed or treated.

The amount of transport material employed in the process of the present invention can vary in accordance with the textile substrate and the treatment conditions, among other variables. For example, the amount of transport material includes the amount that is sorbed by the textile substrate as well as the amount of transport material that is free to circulate and to form entrained droplets in the system. Different fibers and different forms of textile substrates (e.g. yarn package, fabric, etc) will sorb different amounts of water. Wool will absorb most, cotton a little less. Nylon and acrylic will absorb less than cotton and wool. And polyester will absorb almost none. Representative amounts of transport material (e.g. water) are disclosed in the Laboratory Examples presented below.

Thus, the term "trace amount" comprises an amount of transport material needed to result in enough entrainment to accomplish the treatment process plus any additional transport material needed directly in the treatment process. For example, some additional amount of transport material (e.g. water), beyond entrainment needs, can be employed to "swell" fibers such as cellulosics (e.g. cotton) so that they can be treated, but there would be no such need in the case of treating polyester. The amount of free transport material is preferably equal to or less than the weight of the textile substrate being dyed, but will also depend on the particular dye or other treatment material being applied.

The terms "supercritical fluid carbon dioxide" or "SCF—$CO_2$" are meant to refer to $CO_2$ under conditions of pressure and temperature which are above the critical pressure ($P_c$= about 73 atm) and temperature ($T_c$=about 31° C.). In this state the $CO_2$ has approximately the viscosity of the corresponding gas and a density that is intermediate between the density of the liquid and gas states.

The terms "near-critical liquid carbon dioxide" or "NCL-$CO_2$" are meant to refer to liquid $CO_2$ under conditions of pressure and temperature that are near the critical pressure ($P_c$=about 73 atm) and temperature ($T_c$=about 31° C.).

The term "textile treatment material" means any material that functions to change, modify, brighten, add color, remove color, or otherwise treat a textile substrate. Examples comprise UV inhibitors, lubricants, whitening agents, brightening agents and dyes. Representative fluorescent whitening agents are described in U.S. Pat. No. 5,269,815, herein incorporated by reference in its entirety. The treatment material is, of course, not restricted to those listed herein; rather, any textile treatment material compatible with the treatment process is provided in accordance with the present invention.

Representative treatment materials also include but are not limited to antimicrobial agents (e.g., algaecides, bacteriocides, biocides, fungicides, germicides, mildewcides, preservatives); antimigrants (fixing agents for dyes); antioxidants; antistatic agents; bleaching agents; bleaching assistants (stabilizers and catalysts); catalysts; lubricants (coning and winding); crease-resisting finishing agents (anticreasing agents, durable press agents); desizing agents (enzymes); detergents; dye fixing agents; flame retardants; gas fading inhibitors (antifume agents, atmospheric protective agents); fumigants (insecticides and insect repellents); leveling agents; oil repellents; oxidizing agents; penetrating agents (rewetting agents, wetting agents); polymers (resins); reducing agents; retarding agents; scouring agents; soaps; softeners; soil release/stain resistant finishes; souring agents; stripping agents; surfactants; ultraviolet absorbers/light stabilizers; water repellents; waxes; whitening finishes; fluorescent finishes; and combinations of any of the foregoing.

Preferably, the process of the present invention is free of a surfactant that is soluble in the treatment bath, e.g., a surfactant that is soluble in SCF—$CO_2$. Representative embodiments of such surfactants are disclosed in U.S. Pat. No. 6,010,542 issued to DeYoung et al. on Jan. 4, 2000. However, optionally, the transport material can further comprise a surfactant that is substantially insoluble in the treatment bath, but that is soluble in the transport material, e.g., a surfactant that is soluble in water but sparingly soluble in SCF—$CO_2$.

The term "dye" is meant to refer to any material that imparts a color to a textile substrate. Preferred dyes comprise water-soluble and water-dispersible dyes, and many representative dyes are identified in the Colour Index, an art-recognized reference manual.

The term "hydrophilic textile fiber" is meant to refer to any textile fiber comprising a hydrophilic material. More particularly, it is meant to refer to natural and synthetic hydrophilic fibers that are suitable for use in textile substrates such as yarns, fabrics, or other textile substrate as would be appreciated by one having ordinary skill in the art. Preferred examples of hydrophilic materials include cellulosic materials (e.g. cotton, cellulose acetate), wool, silk, nylon and acrylic.

The term "hydrophobic textile fiber" is meant to refer to any textile fiber comprising a hydrophobic material. More particularly, it is meant to refer to hydrophobic polymers that are suitable for use in textile substrates such as yarns, fibers, fabrics, or other textile substrate as would be appreciated by one having ordinary skill in the art. Preferred examples of hydrophobic polymers include linear aromatic polyesters made from terephathalic acid and glycols; from polycarbonates; and/or from fibers based on polyvinyl chloride, polypropylene or polyamide. A most preferred example comprises 150 denier/34 filament type 56 trilobal texturized yarn (polyester fibers) such as that sold under the registered trademark DACRON® Type 54,64 (filaments) and 107W (spun/staple)(E.I. Du Pont De Nemours and Co.). Glass transition temperatures of preferred hydrophobic polymers, such as the listed polyesters, typically fall over a range of about 55° C. to about 65° C. in SCF—$CO_2$.

The term "sparingly soluble", when used in referring to a solute, means that the solute is not readily dissolved in a particular solvent at the temperature and pressure of the solvent. Thus, the solute tends to fail to dissolve in the solvent, or alternatively, to precipitate from the solvent, when the solute is "sparingly soluble" in the solvent at a particular temperature and pressure.

The term "crocking", when used to describe a dyed article, means that the dye exhibits a transfer from dyed material to other surfaces when rubbed or contacted by the other surfaces.

Following long-standing patent law convention, the terms "a" and "an" mean "one or more" when used in this application, including the claims.

II. Representative Textile Treatment Systems

Any machine that has a suitable mechanical configuration can be used in the practice of the process of the present invention. For instance, in each of the Examples presented below, a package dyeing SCF—$CO_2$ system was employed. A representative embodiment of such a system is disclosed in U.S. Pat. No. 6,048,369, issued Apr. 11, 2000 to Smith, et al., herein incorporated by reference in its entirety. Other representative systems are disclosed in U.S. Pat. Nos. 5,298,032; 5,518,088; and 6,010,542; and the contents of each of these patents are incorporated herein by reference in their entirety.

Figure 1B:
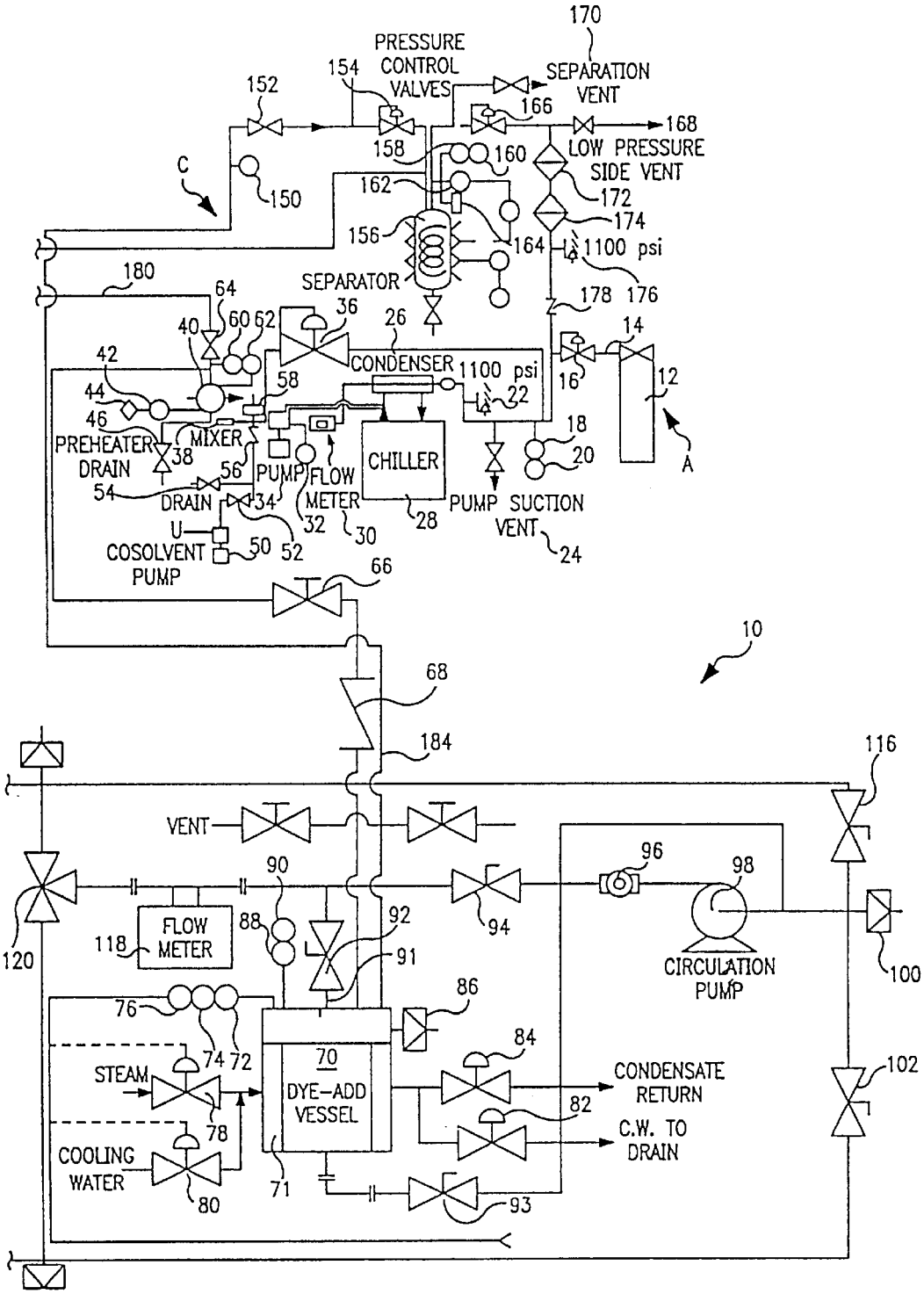
Figure 2:
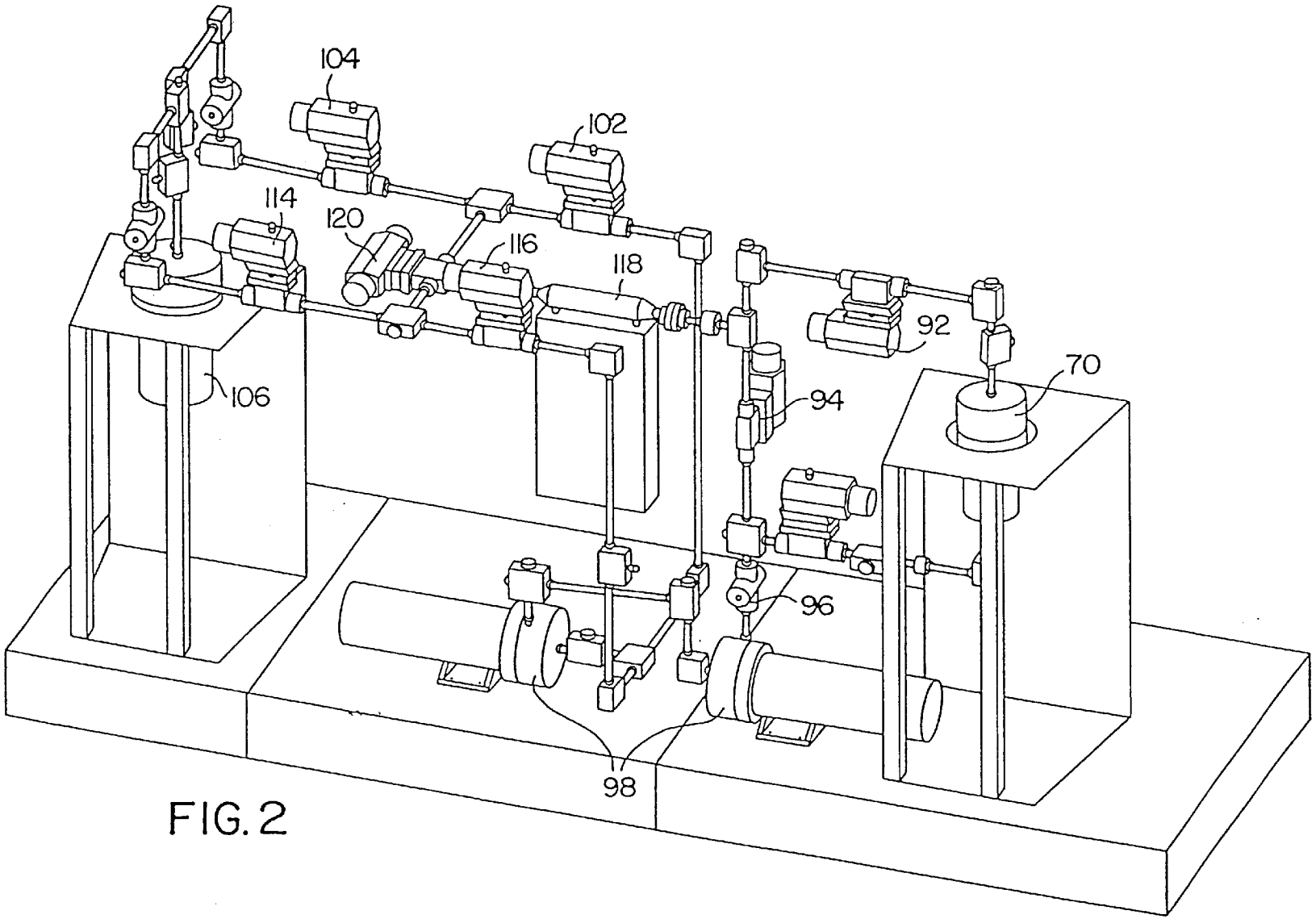
FIG. 2 is a detailed perspective view of a system suitable for use in the textile treatment process of the present invention.

Referring now to FIGS. 1A, 1B and 2, a system suitable for use in the practice of the process of the present invention is referred to generally as 10. In the following detailed description, the parts of system 10 that are primarily involved in the process of the present invention are described. Additionally, a legend describing other parts of system 10 is provided in Table 2 below. For convenience, system 10 is referred to as an SCF—$CO_2$ dyeing system; however, system 10 can be adapted for use with any treatment material and any treatment bath.

TABLE 2

LEGEND FOR FIGS. 1A, 1B AND 2

| Item No. | Name |
|---|---|
| 10 | Supercritical $CO_2$ Treatment System |
| 12 | $CO_2$ Supply Cylinder |
| 14 | Line Section |
| 16 | Pressure Regulating Valve |
| 18 | Pressure Indicator |
| 20 | Pressure Alarm |
| 22 | Pressure Relief Valve |
| 24 | Needle Valve |
| 26 | Condenser (Shell-in-Tube Heat Exchanger) |
| 28 | Chiller |
| 30 | Turbine Flow Meter |
| 32 | Temperature Element (Indicator) |
| 34 | System Pressurization Pump (Positive Displacement) |
| 36 | Pressure Control Valve |
| 38 | Static Mixer |
| 40 | Electric Preheater |
| 42 | Temperature Alarm |
| 44 | Over-Temperature Switch |
| 46 | Needle Valve |
| 50 | Co-Solvent Pump (Positive Displacement) |
| 52 | Needle Valve |
| 54 | Needle Valve |
| 56 | Check Valve |
| 58 | Rupture Disk |
| 60 | Temperature Element (Indicator) |
| 62 | Temperature Controller |
| 64 | Needle Valve |
| 66 | Needle Valve |
| 68 | Check Valve |
| 70 | Dye-Add Vessel |
| 71 | Dye-Add Vessel Jacket |
| 72 | Temperature Element (Indicator) |
| 74 | Temperature Alarm |
| 76 | Temperature Controller |
| 78 | Control Valve (Temperature-Controlled) |
| 80 | Control Valve (Temperature-Controlled) |
| 82 | Control Valve (Temperature-Controlled) |
| 84 | Control Valve (Temperature-Controlled) |
| 86 | Rupture Disk |
| 88 | Pressure Indicator |
| 90 | Pressure Alarm |
| 91 | Line Section |
| 92 | Ball Valve (2-Way) |
| 93 | Ball Valve |
| 94 | Ball Valve (2-Way) |
| 96 | Sight Glass |

TABLE 2-continued

| LEGEND FOR FIGS. 1A, 1B AND 2 | |
|---|---|
| Item No. | Name |
| 98 | Circulation Pump (Centrifugal) |
| 100 | Rupture Disk |
| 102 | Ball Valve (2-Way) |
| 104 | Ball Valve (2-Way) |
| 106 | Dyeing Vessel |
| 107 | Dyeing Vessel Jacket |
| 108 | Line Section |
| 109 | Needle Valve |
| 110 | Pressure Indicator |
| 114 | Ball Valve (2-Way) |
| 116 | Ball Valve (2-Way) |
| 118 | Coriolis Flow Meter |
| 120 | Ball Valve (3-Way) |
| 122 | Temperature Element (Indicator) |
| 124 | Temperature Alarm |
| 126 | Temperature Controller |
| 128 | Pressure Indicator |
| 130 | Pressure Alarm |
| 132 | Control Valve (Temperature-Controlled) |
| 134 | Control Valve (Temperature-Controlled) |
| 136 | Control Valve (Temperature-Controlled) |
| 138 | Control Valve (Temperature-Controlled) |
| 140 | Rupture Disk |
| 142 | Needle Valve |
| 144 | Needle Valve |
| 146 | Line Section |
| 148 | Needle Valve |
| 150 | Temperature Element (Indicator) |
| 152 | Needle Valve |
| 154 | Pressure Control Valve |
| 156 | Separator Vessel |
| 158 | Pressure Indicator |
| 160 | Pressure Alarm |
| 162 | Temperature Element (Indicator) |
| 164 | Rupture Disk |
| 166 | Pressure Control Valve |
| 168 | Needle Valve |
| 170 | Needle Valve |
| 172 | Filter |
| 174 | Filter |
| 176 | Pressure Relief Valve |
| 178 | Check Valve |
| 180 | Line Section |
| 182 | Check Valve |
| 184 | Line Section |

Referring particularly to FIGS. 1A, 1B and 2, operation and control of the SCF—$CO_2$ dyeing system 10 optionally encompasses three distinct equipment subsystems. The subsystems include filling and pressurization subsystem A, dyeing subsystem B, and venting subsystem C. Carbon dioxide is introduced into system 10 via $CO_2$ supply cylinder 12. Preferably, supply cylinder 12 contains liquid carbon dioxide. Thus, liquid $CO_2$ enters the filling and pressurization subsystem A from the supply cylinder 12 through line section 14 and regulating valve 16 and is cooled in condenser 26 by a water/glycol solution supplied by chiller 28. The $CO_2$ is cooled to assure that it remains in a liquid state and at a pressure sufficiently low to prevent cavitation of system pressurization pump 34.

Continuing with FIGS. 1A, 1B and 2, turbine flow meter 30 measures the amount of liquid $CO_2$ charged to dyeing system 10. Pump 34 increases the pressure of the liquid $CO_2$ to a value above the critical pressure of $CO_2$ but less than the operating pressure for the dyeing system, typically ranging from about 1000 psig to greater that about 4000 psig, depending of the particular textile substrate being dyed or otherwise treated. A side-stream of water/glycol solution from chiller 28 provides cooling for pump 34. Control valve 36 allows pump 34 to run continuously by opening to bypass liquid $CO_2$ back to the suction side of pump 34 once the system pressure set point has been reached. This valve closes if the system pressure falls below the set point that causes additional liquid $CO_2$ to enter the dyeing subsystem B. Optionally, the transport material can be injected into the liquid $CO_2$ stream by pump 50 at the discharge of pump 34 and mixed in by static mixer 38.

Continuing with FIGS. 1 and 2, liquid $CO_2$ leaving mixer 38 enters electrical pre-heater 40 where its temperature is increased. Heated and pressurized $CO_2$ can enter the dyeing subsystem B through needle valve 66 and into dye-add vessel 70; through needle valve 64 and into dyeing vessel 106; or through both of these paths. Typically, dyeing subsystem B is filled and pressurized simultaneously through both the dye-add and dyeing vessels 70 and 106, respectively.

Once a sufficient quantity of liquid $CO_2$ has been charged to dyeing subsystem B to achieve the operating density, typically a value in the range of 0 to about 0.75 g/cm$^3$, preferably about 0.2 to about 0.7 g/cm$^3$, more preferably to about 0.25 to 0.50 g/cm$^3$, circulation pump 98 is activated. Optionally, system 10 is configured so that circulation pump 98 first drives the flow of liquid $CO_2$ through the dyeing vessel 106, which contains a textile substrate that has been wetted out with transport material. Contacting of the liquid $CO_2$ flow with the textile substrate that has been wetted out with transport material entrains the transport material into the liquid $CO_2$ flow.

Once circulation is started, heating of subsystem B is initiated by opening control valves 78 and 84 to supply steam to and remove condensate, respectively, from the heating/cooling jacket 71 on dye-add vessel 70. Similarly, control valves 132 and 136 are opened to supply steam to and remove condensate from, respectively, the heating/cooling jacket 107 on dyeing vessel 106. Commercial practice would utilize a heat exchanger in the circulation loop to provide for heating of the $CO_2$ rather than relying on heating through the vessel jackets 71 and 107. Heating is continued until the system passes the critical temperature of $CO_2$ and reaches the operating, or dyeing, temperature, typically ranging from about ambient (e.g., 22° C.–25° C.) to about 130° C., preferably ranging from about 25° C. to about 100° C., more preferably ranging from about 40° C. to about 95° C.

Continuing with FIGS, 1A, 1B and 2, SCF—$CO_2$ leaving circulation pump 98 passes through sight glass 96 and is diverted, by closing ball valve 94 and opening ball valve 93, through dye-add vessel 70 where dye is dissolved and/or suspended in the transport material. Transport material-laden SCF—$CO_2$ passes out of the dye-add vessel 70 through ball valve 92 and flow meter 118 to ball valve 120. Ball valve 120 is a three-way valve that diverts the SCF—$CO_2$ flow to the inside or outside of the package loaded in dyeing vessel 106 depending on the direction in which it is set. If ball valve 120 is set to divert flow in the direction of ball valve 104, and ball valve 104 is open and ball valve 102 is closed, then all of the SCF—$CO_2$ flow proceeds to the inside of the dye spindle (not shown in FIGS. 1A, 1B and 2). The flow continues from the inside to the outside of the dye spindle, from the inside to the outside of the dye tube (not shown in FIGS. 1A, 1B and 2) on which the textile yarn package is wound and out through the textile yarn package to the interior of dyeing vessel 106. The SCF—$CO_2$ flow passes out of dyeing vessel 106, through open ball valves 114 and 116 to the suction of pump 98, completing a circuit for inside-to-outside dyeing of the yarn package.

If ball valve 120 is set to divert flow in the direction of ball valve 114, and ball valve 114 is open and ball valve 116 is closed, then all of the SCF—$CO_2$ flow proceeds to the interior of dyeing vessel 106 and the outside of the textile yarn package. The flow passes through the textile yarn package, continues from the outside to the inside of the dye tube on which the yarn is wound and then passes from the outside to the inside of the dye spindle. The SCF—$CO_2$ flow exits the interior of the dye spindle and passes through open ball valves 104 and 102 to the suction of pump 98, which completes a circuit for outside-to-inside dyeing of the textile yarn package.

The SCF—$CO_2$ flow having treatment material-laden transport material entrained therein is held at values ranging from values of 1 gallon per minute (GPM)/lb of textile or less, to values greater than 15 GPM/lb of textile. The treatment bath flow is periodically switched between the inside-to-outside(I–O) circuit and the outside-to-inside (O–I) circuit to promote uniformity of dyeing of the textile yarn; e.g., 6 min./2 min. I–O/O–I, 6 min./4 min. I–O/O–I, 5 min./5 min. I–O/O–I, etc. This dyeing process is continued with system 10 held at the dyeing temperature, usually about ambient temperature to about 130° C., and preferably about 40° C. to 95° C., until the treatment material in the transport material is exhausted onto the textile substrate to produce an even distribution, typically around 30 minutes.

Continuing with reference to FIGS. 1A, 1B and 2, venting is initiated by opening needle valve 109 to provide a flow path from the dyeing vessel 106 to control valve 154. Control valve 154 is opened to set the pressure in dyeing subsystem B and control valve 166 is opened to set the pressure in separator vessel 156. By adjusting control valves 154 and 166 appropriately, the pressure in the dyeing vessel 106 is reduced at a controlled rate. Dye-add vessel 70 is isolated during venting to prevent any additional dye remaining in dye-add vessel 70 from going into solution in the transport material that is entrained in the SCF—$CO_2$. Isolation of dye-add vessel 70 is accomplished by closing ball valves 92 and 93 while opening ball valve 94 to maintain a circulation loop for the dyeing vessel.

During venting SCF—$CO_2$ flows from dyeing subsystem B through control valve 154 and into separator vessel 156 of venting subsystem C. In separator vessel 156 the pressure is sufficiently low so that the $CO_2$ is in the gaseous phase and any contaminants, and the treatment material solids collect in separator vessel 156 and gaseous $CO_2$ exits through control valve 166. Once the gaseous $CO_2$ passes through control valve 156 it can be vented to atmosphere by opening needle valve 168. The gaseous $CO_2$ can also be recycled to filling and pressurization subsystem A by keeping needle valve 168 closed so that the gaseous $CO_2$ passes through filters 172 and 174. Filters 172 and 174 collect any minute amounts of solids that can have escaped separator vessel 156 with the gaseous $CO_2$ flow. The gaseous $CO_2$ exiting filters 172 and 174 passes through check valve 178 and enters filling and pressurization subsystem A for re-use in system 10.

Figure 3:
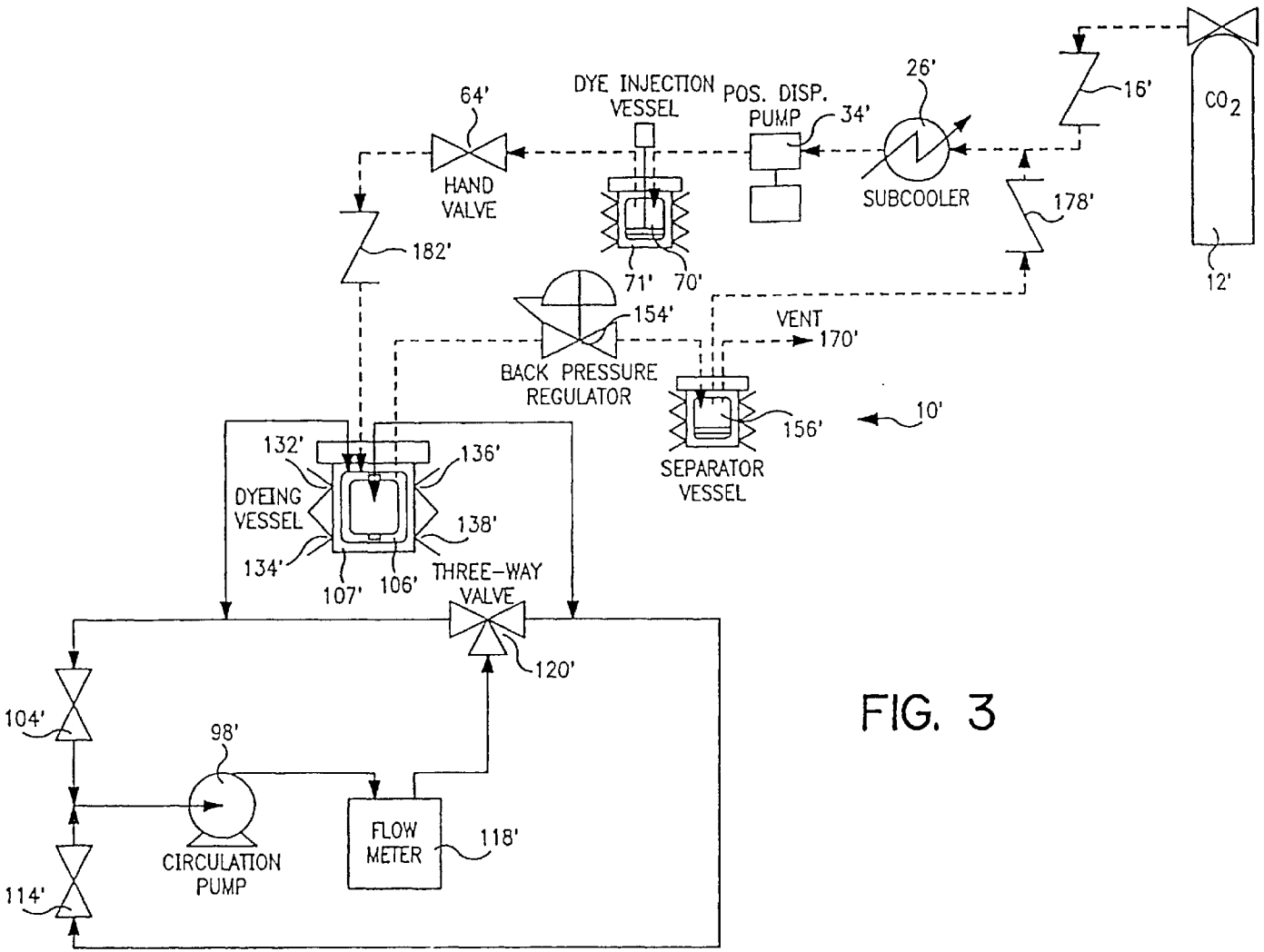
FIG. 3 is a schematic of an alternative embodiment of a system suitable for use in the textile treatment process of the present invention.

Referring now to FIG. 3, an alternative system 10' for use in the SCF—$CO_2$ dyeing process of the present invention is depicted schematically. Generally, however, system 10' works in a similar manner as system 10 described above and as depicted in FIGS. 1 and 2. System 10' includes a $CO_2$ cylinder 12', from which $CO_2$ flows through check valve 16' to a cooling unit 26'. $CO_2$ is cooled and pressurized within cooler 26' and then is pumped, using positive displacement pump 34', into dye injection vessel 70'. Prior to introduction of $CO_2$ into vessel 70', a dyestuff is placed within vessel 70'. In dye injection vessel 70', the treatment material, i.e., the dyestuff, is dissolved and/or suspended into the transport material, which is preferably water or an aqueous solution. Thus, when $CO_2$ is introduced into vessel 70' the dye-laden transport material is entrained within the SCF—$CO_2$ flow.

Continuing with FIG. 3, the action of pump 34' drives the SCF—$CO_2$ that has dye-laden transport material entrained therein out of dye injection vessel 70' through a hand valve 64' and a check valve 182' into a dyeing vessel 106' that contains the textile substrate to be dyed. Dyeing vessel 106' is pressurized and heated to SCF dyeing conditions prior to the introduction of the SCF—$CO_2$ that has dye-laden transport material entrained therein. Steam and/or cooling water are introduced to jacket 107' of dyeing vessel 106' via valves 132' and 134', respectively. Thus, appropriate temperatures for dyeing are achieved in vessel 106'. During and after dyeing, any condensate resulting from the introduction of steam through valve 132' is exported through vent 136' and any water introduced via valve 134' is exported through drain 138'.

Continuing with FIG. 3, during dyeing, the SCF—$CO_2$ flow that has dye-laden transport material entrained therein is circulated into and out of vessel 106' via circulation pump 98', valves 104' and 114', and 3-way valve 120' in a manner analogous to that described above for system 10, valves 104 and 114, and 3-way valve 120. Flow meter 118' is placed in system 10' between circulation pump 98' and 3-way valve 120' so that the flow rate of SCF—$CO_2$ can be monitored. Dyeing is thus facilitated by the circulation subsystem. Further, the action of circulation pump 98' maintains system flow during the treatment process.

Continuing with particular reference to FIG. 3, after a predetermined time, preferably when substantially exhaustion of the treatment material in the transport material onto the textile substrate is observed, SCF—$CO_2$ is removed from dyeing vessel 106' and flows through back pressure regulator 154'. At this point, the pressure of the process is reduced and $CO_2$ within the system is introduced into separator vessel 156'. Any contaminants, likely a small amount, are removed from the $CO_2$ in separator vessel 156'. $CO_2$ then can be vented through vent 170'. Alternatively, $CO_2$ can be recycled back into system 10' via check valve 178'.

Figure 4:
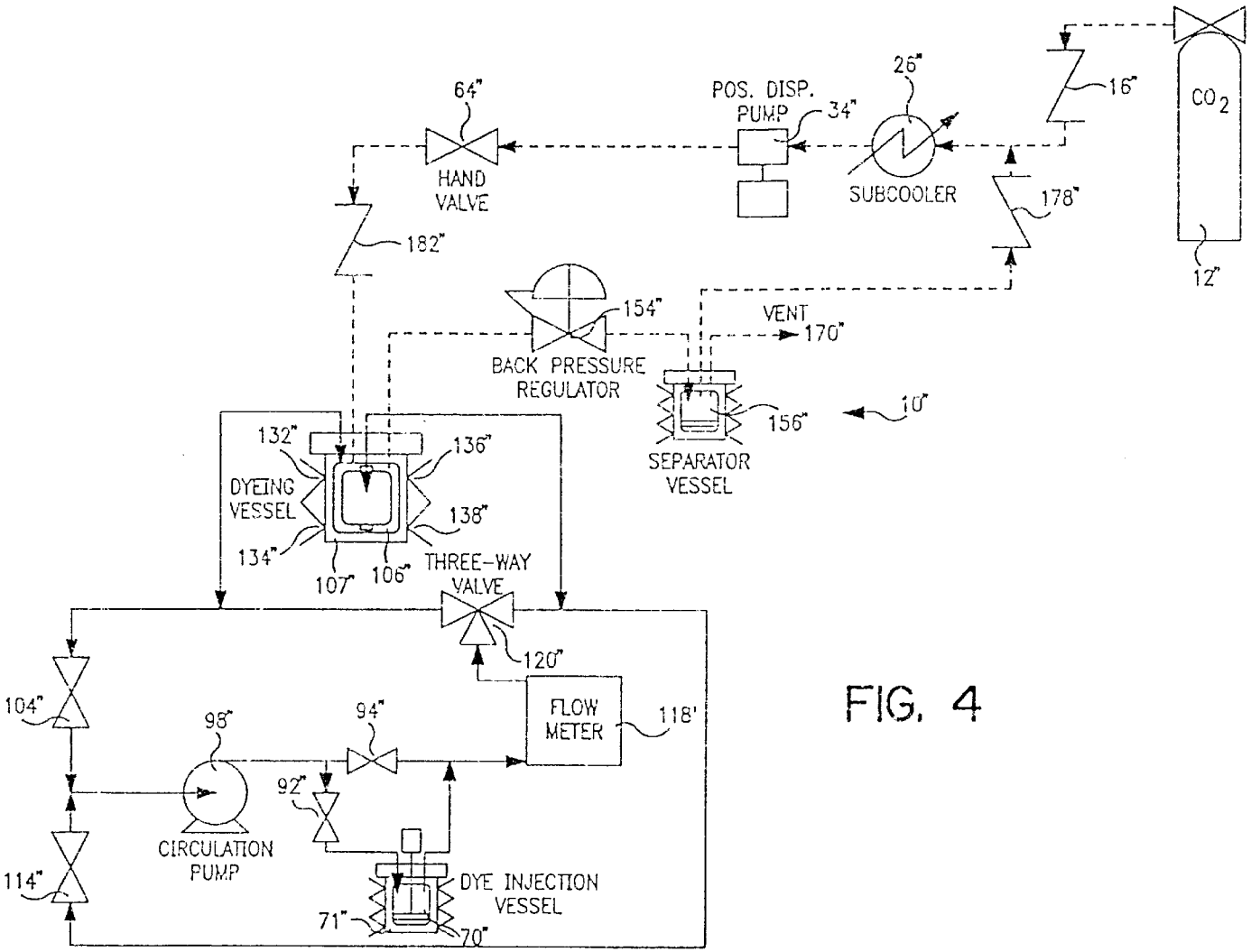
FIG. 4 is a schematic of another alternative embodiment of a system suitable for use in the textile treatment process of the present invention.

Referring now to FIG. 4, another alternative embodiment of a suitable system for use in the process of the instant invention is described. System 10" includes $CO_2$ cylinder 12". $CO_2$ flows from cylinder 12" through check valve 16" into subcooler 26". The temperature of the $CO_2$ is reduced within subcooler 26" to assure that is remains in a liquid state and at a pressure sufficiently low to prevent cavitation of positive displacement pump 34". The positive displacement pump 34" then drives the $CO_2$ through hand valve 64", then through a check valve 182", into dyeing vessel 106". Dyeing vessel 106" includes the textile fibers to be dyed. In dye injection vessel 70', the treatment material, i.e., the dyestuff, is dissolved and/or suspended into the transport material, which is preferably water or an aqueous solution.

Continuing with particular reference to FIG. 4, dyeing vessel 106" is pressurized and heated to produce $CO_2$ at SCF temperature and pressure. SCF—$CO_2$ is then exported from vessel 106" using circulation pump 98" and valves 104" and 114" in a manner analogous to that described above for system 10 and valves 104 and 114. SCF—$CO_2$ is introduced via valve 92" into a dye injection vessel 70" containing a suitable dye. The dye is dissolved and/or suspended in the transport material in dye injection vessel 70", and the transport material is entrained in the SCF—$CO_2$ in dye injection vessel 70". Circulation pump 98" drives the SCF—

$CO_2$ that has the dye-laden transport material entrained therein from vessel 70" through flow meter 118" and 3-way valve 120" back into dyeing vessel 106" wherein dyeing of the textile fibers is accomplished. During dyeing, steam and/or cooling water are introduced to jacket 107" of dyeing vessel 106" via valves 132" and 134", respectively. Thus, appropriate temperatures for dye dissolution and dyeing are achieved in vessel 106". During and after dyeing, any condensate resulting from the introduction of steam through valve 132" is exported through vent 136" and any water introduced via valve 134" is exported through drain 138".

Continuing with FIG. 4, after a predetermined time, preferably when substantially complete exhaustion of the treatment material in the transport material onto the textile substrate is observed, the SCF—$CO_2$ dye bath is removed from vessel 106" to back pressure regulator 154". The pressure of the process is then reduced using regulator 154" and the resulting $CO_2$ phase is then introduced into separator vessel 156". In separator vessel 156" the pressure is further reduced so that any contaminants, likely a small amount, are deposited within separator vessel 156" and the resulting contaminant-free $CO_2$ gas is removed from separator vessel 156". Particularly, the contaminant-free $CO_2$ gas can be vented using vent 170" or can be recycled back into system 10" via check valve 178". An aspect of the efficiency of the process of this invention is thus demonstrated.

The present invention also provides a treatment material introduction system to facilitate introduction of a textile treatment material, such as a dye, into a textile treatment process. Preferably, the treatment material is dissolved, dispersed and/or suspended in the transport material when it contacts the treatment bath used in the treatment process.

Figure 5:
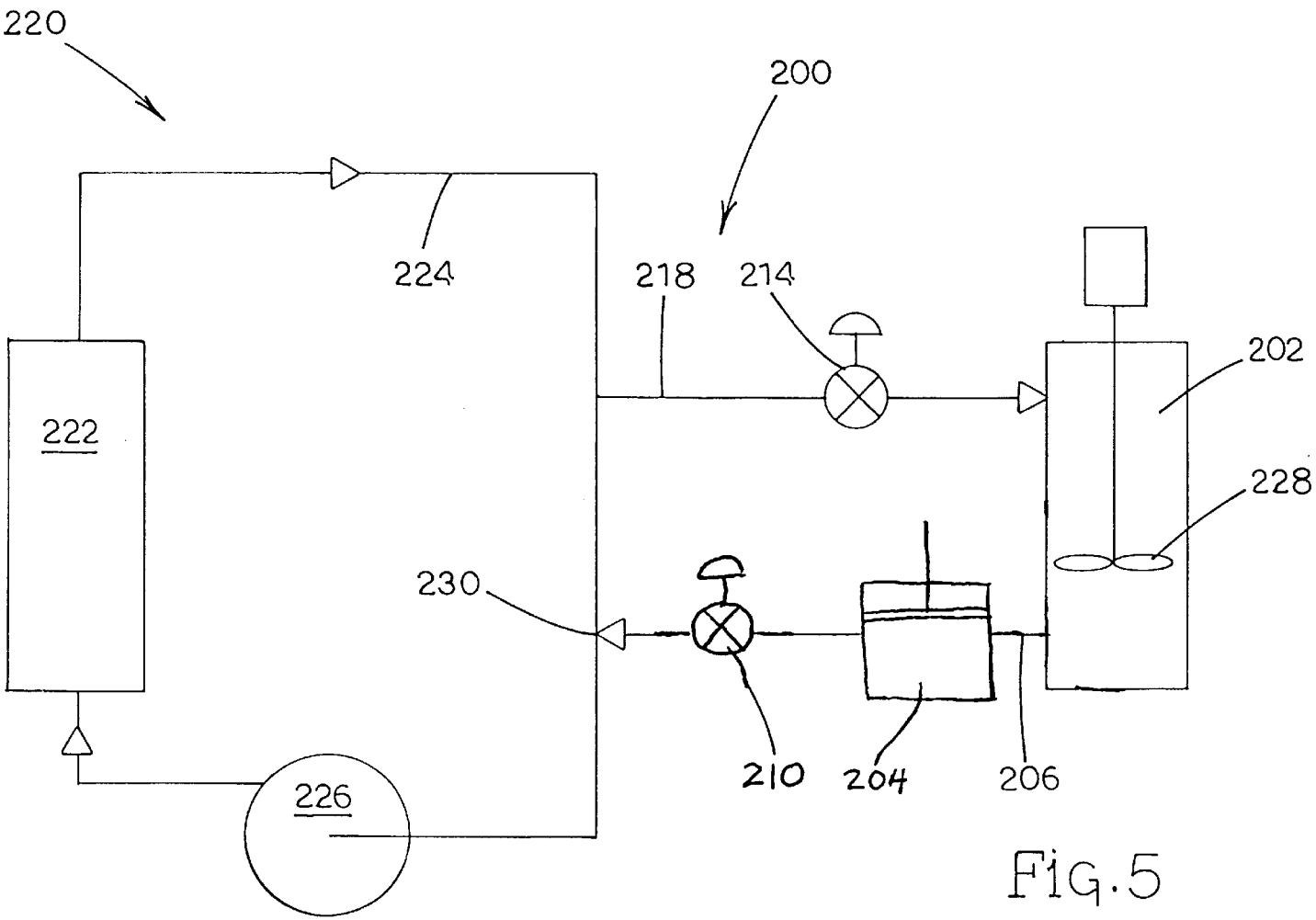
FIG. 5 is a schematic of a system for introducing textile treatment materials into a textile treatment system in accordance with a process of the present invention.

Referring again to the drawings, a representative embodiment of a textile treatment material introduction system of the present invention is generally designated 200 in FIG. 5. Referring to FIG. 5, system 200 introduces textile treatment materials dissolved and/or suspended in transport material into a textile treatment system 220, which preferably comprises a SCF—$CO_2$ textile treatment system such as that described in detail above. System 200 comprises dye-add or preparation vessel 202, positive-displacement metering pump 204, line section 206, control valves 210 and 214, and return line 218. Treatment system 220 comprises a treatment vessel 222, a circulation loop 224 and a circulation pump 226.

Continuing with reference to FIG. 5, a textile treatment material is placed in preparation vessel 202, which is equipped with a stirring device 228 capable of thoroughly mixing the contents of vessel 202. Stirring device 228 comprises a motor-driven fan, but can also comprise a motor-driven shaft, a rotatably mounted shaft, or any other suitable stirring device as would be apparent to one of ordinary skill in the art after reviewing the disclosure of the present invention. Other stirring devices include a fan, propeller or paddle that is magnetically coupled to a motor rather than coupled to the motor by a solid shaft. Such devices, and equivalents thereof, thus comprise "stirring means" and "mixing means" as used herein and in the claims.

Continuing with reference to FIG. 5, in operation the preparation vessel 202 of system 200 is charged with transport material and treatment material and sealed. The amount of transport material initially charged depends on the transport material concentration desired at the introduction conditions. If a surfactant or dispersing agent, each of which is also soluble in the transport material is to be used, it is charged along with the textile treatment material, or introduced with a metering pump (not shown in FIG. 5) into the preparation vessel 202 at some point in the textile treatment material preparation process. The contents of the preparation vessel 202 are then heated with mixing to the introduction conditions, which can optionally, but are not required to, encompass a pressure that is near the textile treatment system pressure.

Introduction system 200, and particularly preparation vessel 202, can be isolated from treatment system 220 when the solution or suspension of textile treatment material is prepared in the transport material. Control valves 210 and 214 are used to isolate preparation vessel 202 and thus can be opened and closed for reversibly isolating preparation vessel 202. Any other suitable structure, such as other valves, piping or couplings, as would be apparent to one of ordinary skill in the art after reviewing the disclosure of the present invention can also be used to isolate, preferably to reversibly isolate, preparation vessel 202. Such devices and structures, and equivalents thereof, thus comprise "isolation means" as used herein and in the claims.

During introduction of treatment material laden transport material, introduction system 200 can be operated in several different modes. In one mode, introduction is accomplished with closed valve 214 so that only treatment material laden transport material is introduced into the treatment system through open valve 210. That is, vessel 202 is emptied of treatment material laden transport material without any other type of communication with the treatment system. In a second mode, treatment material laden transport material is mixed with SCF—$CO_2$ in vessel 202. In this case, a mixture of SCF—$CO_2$ and treatment material laden transport material is prepared for introduction into the treatment system. Introduction of this mixture can be with valve 214 closed or open. If valve 214 is closed during the introduction process, vessel 202 is emptied of the mixture of SCF—$CO_2$ and treatment material laden transport material through open valve 210, without any other type of communication with the treatment system. If valve 214 is open during the introduction process, vessel 202 is replenished with a mixture of SCF—$CO_2$ and transport material while a mixture of SCF—$CO_2$ and treatment material laden transport material is introduced into the treatment system through open valve 210. This last operating mode might be used in the case that the amount of transport material is insufficient to instantaneously dissolve all of the treatment material resident in vessel 202. In this case, the stream of SCF—$CO_2$ entering vessel 202 through open valve 214 would contain transport material exhausted of treatment material and, thereby, ready to dissolve or suspend more treatment material.

Continuing with reference to FIG. 5, positive-displacement metering pump 204 introduces the textile treatment material-laden transport material (or mixture of SCF—$CO_2$ and treatment material-laden transport material) into the circulation loop 224 of treatment system 220 using an introducing rate profile that is consistent with producing uniformly-treated textile substrates in minimum processing time. In a preferred embodiment, pump 204 shown in FIG. 5 comprises a positive displacement pump with a reciprocating piston. Other representative pumps include a syringe type pump employing a mechanical piston and a syringe type pump employing an inert fluid as a piston. Thus, devices such as pumps, nozzles, injectors, combinations thereof, and other devices as would be apparent to one of ordinary skill in the art after reviewing the disclosure of the present invention, and equivalents thereof, comprise "introducing means" as used herein and in the claims.

Mixing of the preparation vessel 202 is continued throughout the introduction cycle via mechanical stirring with stirring device 228. Introducing of the textile treatment material-laden transport material (or mixture of SCF—$CO_2$ and treatment material-laden transport material) occurs at an introduction point 230 in the circulation loop 224 where fluid shear is very high. It is also preferred that introduction point 230 lie relatively near the dyeing/treatment vessel in order to avoid possible recombination of the droplets of the transport material before interaction with the textile substrate; this point could be before or after circulation pump 224 as long as pump 224 is sufficiently close to the dyeing/treatment vessel to avoid droplet recombination. For example, point 230 can lie before or after circulation pump 224 or in a mixing zone that contains static mixing elements (not shown in FIG. 5) in order to facilitate mixing with the treatment medium (e.g. SCF—$CO_2$) flowing in circulation loop 224 of treatment system 220. The term "high fluid shear" refers to a turbulent flow or a flow with high rate of momentum transfer. Preferably, the term "high fluid shear" refers to a flow having a Reynolds number greater than 2300, and more preferably, greater than 5000.

Figure 6:
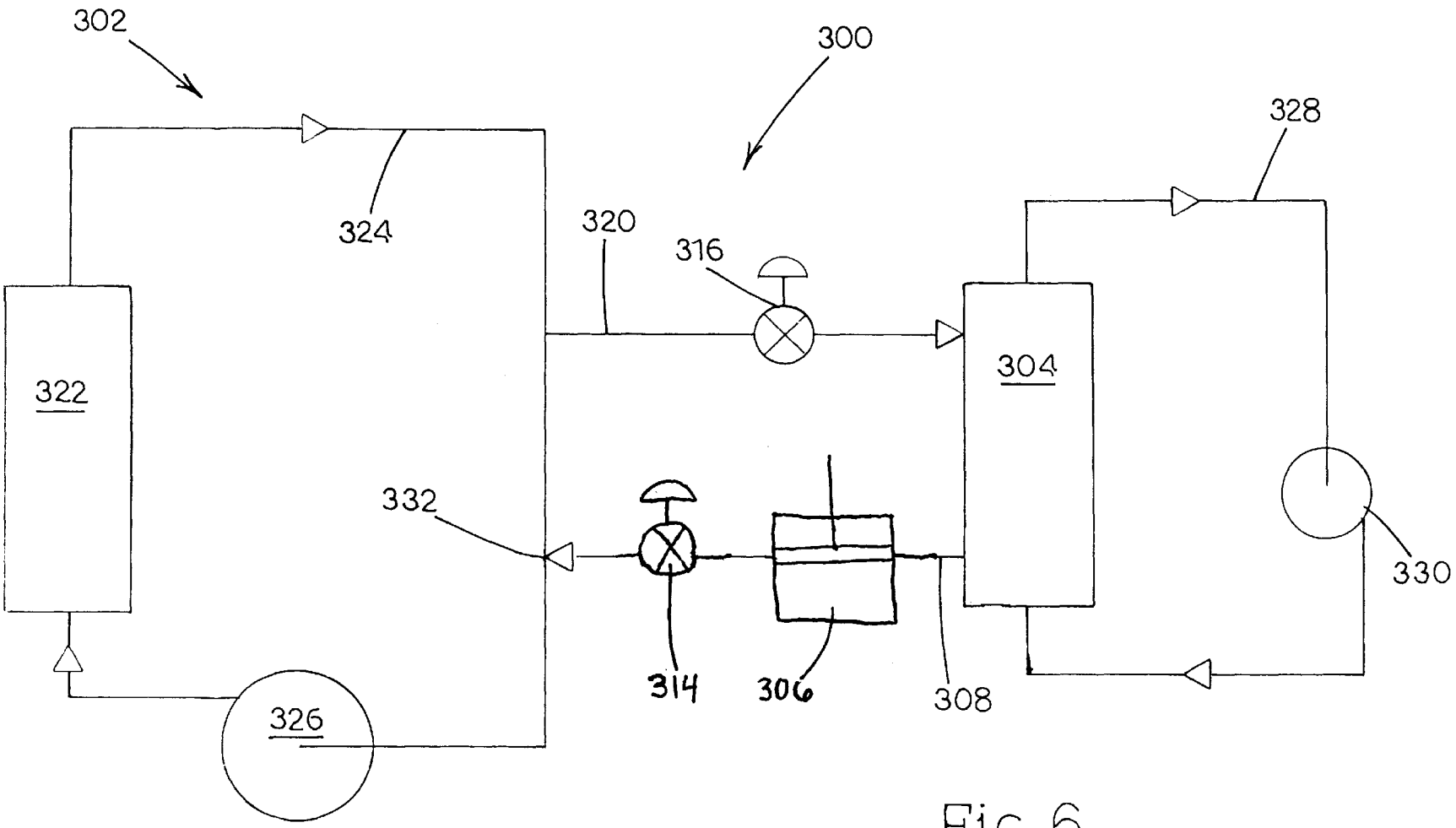
FIG. 6 is a schematic of a system for introducing textile treatment materials into a textile treatment system in accordance with a process of the present invention.

Referring now to FIG. 6, an alternative embodiment of the textile treatment material introduction system 200 shown in FIG. 5 is disclosed and generally designated 300. In alternative embodiment 300, treatment materials are introduced in transport material into textile treatment system 302, which preferably comprises a SCF—$CO_2$ textile treatment system as described hereinabove. System 302 comprises dye-add or preparation vessel 304, positive-displacement metering pump 306, line section 308, control valves 314 and 316, and return line 320. Treatment system 302 comprises a treatment vessel 322, a circulation loop 324 and a circulation pump 326.

Textile treatment material is placed in the preparation vessel 304 of system 300. Preparation vessel 304 is equipped with a mixing loop 328 as shown in FIG. 3. Thus, mixing of the preparation vessel 304 is continued throughout the introducing cycle via fluid circulation (demonstrated by arrows in FIG. 3) by circulation pump 330 through mixing loop 328. Such devices and structures, and equivalents thereof, thus comprise "circulation means" and "mixing means" as used herein and in the claims. Other aspects of alternative embodiment 300 function as described above, including the introduction of treatment material at high fluid shear introduction point 332.

Figure 7:
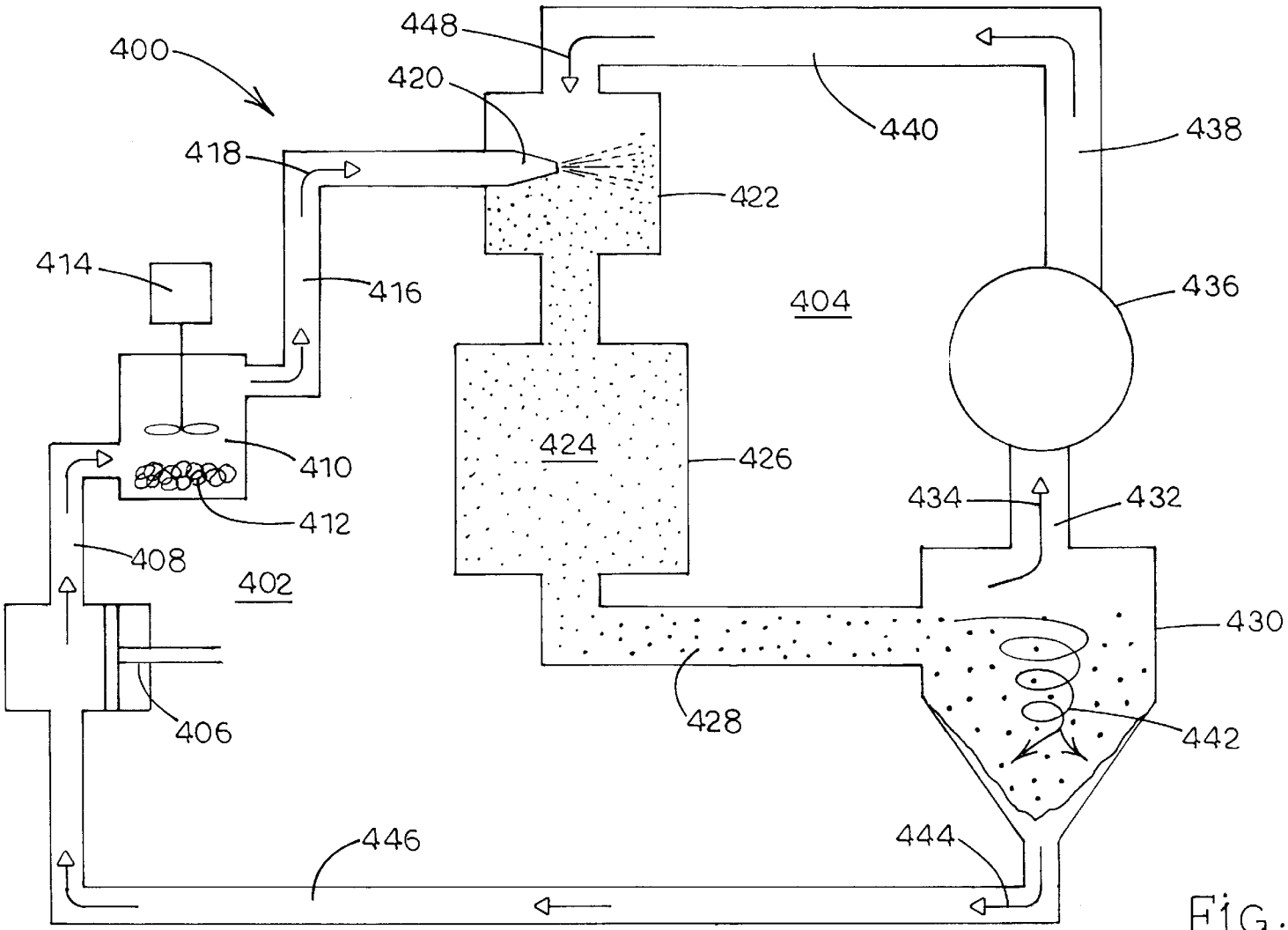
FIG. 7 is a schematic of a textile treatment system suitable for use in a process of the present invention, wherein the system includes a treatment material preparation subsystem and a dyeing/treatment subsystem.

Referring now to FIG. 7, yet another embodiment of a textile treatment system for use in a process of the present invention is generally referenced at 400. System 400 comprises a treatment material preparation subsystem 402 and a dyeing/treatment subsystem 404. Preparation subsystem 402 further comprises an injection pump 406; a preparation vessel 410 with a mixer 414; line sections 408 and 416; and an atomizing nozzle 420. Dyeing/treatment subsystem 404 further comprises a bath preparation vessel 422; a treatment vessel 426; line sections 428, 432, 438, 440 and 446; centrifugal separator 430; and circulation pump 436.

Continuing with FIG. 7, a transport material is introduced into treatment material preparation subsystem 402 via injection pump 406. The transport material travels through line section 408 to treatment material preparation vessel 410, where a treatment material 412 is dissolved, dispersed and/or suspended in the transport material. The dissolving, dispersing and/or suspending of treatment material 412 is facilitated by the action of mixer 414. Treatment material-laden transport material 418 then travels through line section 416 to atomizing nozzle 420. The treatment material-laden transport material 418 coming from preparation vessel 410 is added in the form of suitably small droplets to bath preparation vessel 422 via atomizing nozzle 420 and the action of injection pump 406.

Continuing with FIG. 7, a dyeing/treatment bath 424 is prepared by passing bath fluid (flow represented by arrow 448) through bath preparation vessel 420. Dyeing/treatment bath 424 then passes on to dyeing/treatment vessel 426, which holds the textile substrate to be dyed or treated. After exiting dyeing/treatment vessel 426, dyeing/treatment bath 424 passes into a centrifugal separator 430 via line section 428. In centrifugal separator 430, the transport material is separated from the bath fluid by centrifugation, as indicated by arrows 442. As indicated by flow arrows 434, bath fluid that is substantially free of transport material leaves centrifugal separator 430 via line section 432 and is circulated by circulation pump 436 through line section 438 back to preparation vessel 422. Indeed, circulation pump 436 drives the flow of bath fluid and transport material for the dyeing/treatment process as a whole. As indicated by flow arrow 444, the transport material is returned to injection pump 406 via line section 446 and subsequently is reintroduced into vessel 410. As described above, the treatment material-laden transport material (represented by flow arrow 418) coming from preparation vessel 410 is added in the form of suitably small droplets to bath preparation vessel 422 via atomizing nozzle 420 and the action of injection pump 406. In this way, a continuous flow of properly prepared dyeing/treatment bath 424 is provided to dyeing/treatment vessel 426 and to the dyeing process as a whole.

In the system embodiment presented in FIG. 7, bath preparation vessel 422 is integrated within dyeing/treatment subsystem 404. In order to faciliate uniform dyeing or treatment of the textile substrate, the droplet size for the entrained transport material is preferably very small, on the order a few microns or less. A very small droplet size provides intimate, vigorous contact of the transport material containing the dye or treatment chemical with the textile substrate. This process parameter plays a large role in applications where the dyeing/treatment bath must pass through the micron size pore spaces between individual yarns and fibers; e.g., in the dyeing or treatment of yarn packages.

In the system embodiment presented in FIG. 7, atomizing nozzle 420 produces small droplets of dye-laden or treatment material-laden transport material, but other techniques and devices for accomplishing this operation are also provided in accordance with the present invention. For example, a sub-stream of "clean" bath fluid can be removed from the main stream of this fluid before it enters bath preparation vessel 422. The substream is then reintroduced along with dye-laden or treatment material-laden transport material into bath preparation vessel 422 using a mixing nozzle. That is, bath fluid and dye-laden or treatment material-laden transport material are atomized together into the main bath flow using a mixing nozzle.

In another approach, atomizing nozzle 420 is replaced by a sparging device with numerous, very small sparging holes; e.g., the sparging media can be sintered metal with micron sized pores. In this case, the dye-laden or treatment material-laden transport material is forced through the sparging device, thereby creating small droplets of dye-laden or treatment material-laden transport material that mix with the bath fluid. In yet another approach, the transport material and bath fluid are mixed together in bath preparation vessel 422 using vigorous agitation, such as that generated by a high-speed stirrer or high-speed flow through turbulenceproducing devices such as baffles. The examples discussed here are meant to be illustrative only, and not limiting. Indeed, any device that introduces very small droplets into the inert, non-aqueous bath fluid can be utilized.

In the system embodiment presented in FIG. 7, it is preferred that dyeing/treatment vessel 426 has a design that is particular to the textile fiber being processed as well as to the form of the textile substrate. For example, equipment that is used in treating natural fibers such as cotton, silk and wool generally varies from that used to treat synthetic fibers such as polyester and nylon. Systems to dye or treat yarn, fabric or garments can also vary, and in some cases, can be substantially different. Examples of such differences include, but are not limited to, multiple ports into dyeing/treatment vessel 426 for dyeing/treatment bath entry, mechanical movement of the textile substrate being treated, and/or a piping and valve system capable of accomplishing flow reversal. In each case, uniform contact of dyeing/treatment bath 424 with the textile substrate is provided.

Continuing with FIG. 7, as dyeing/treatment bath 424 passes through and exits dyeing/treatment vessel 426 droplets of transport material suspended in the bath fluid could interact to form larger droplets. Eventually the droplet size could be too large to assure rapid and uniform dying/treatment of the textile substrate. For this reason, it is preferred for some textile substrates that the transport material is separated from the bath fluid and reintroduced into bath preparation vessel 422 in fine droplet form, as discussed above.

In the system embodiment presented in FIG. 7, centrifugal separator 430 removes the transport material from the fluid, but other techniques and devices for accomplishing this operation are provided in accordance with the present invention. For example, a settling chamber can be employed. This device is a large tank in which the fluid velocity slows sufficiently to allow entrained transport material to settle by gravity. Since the density of the transport material might be 2–3 times that of the bath fluid, such a device can provide the desired separation. The efficiency of a settling chamber would likely be improved by adding baffles or other solid surfaces to further slow the flow of the transport material and cause agglomeration, so that separation by gravity is enhanced.

Another potential separation method is filtration. Because the viscosity of the transport material is likely much greater than that of the bath fluid, the bath fluid will be expected to pass through the filter while the transport material collects on the upstream side. In this case, the "clean" bath fluid from downstream of the filter is sent to bath preparation vessel 422, while the transport material from upstream of the filter is siphoned off for reintroduction in bath preparation vessel 422. The examples discussed here are meant to be illustrative only, and not to be limiting. Any device that can efficiently separate the transport material from the bath fluid can be utilized.

In the system embodiment presented in FIG. 7, the transport material can be initially introduced into treatment material preparation subsystem 402 by a variety of techniques and devices. For example, since the textile substrate is preferably initially wetted-out with the transport material, the substrate can be provided with enough excess of transport material to meet the droplet entrainment needs. Alternatively, the amount of transport material needed for proper droplet entrainment can be introduced along with treatment material 412 into treatment material preparation vessel 410. In yet another alternative, the transport material is injected into dyeing/treatment bath 424 at some convenient point in the process with respect to both time and location. The examples discussed here are meant to be illustrative only, and non-limiting, Thus, any device that efficiently dissolves, disperses or suspends a dye or another treatment material in a suitable amount of transport material can be utilized.

Once dyeing/treatment is complete, partial or complete removal of excess transport material from the textile substrate can optionally be accomplished by continuing the dyeing/treatment bath flow while ceasing reintroduction of the transport material. This process step allows a "clean" bath flow to "strip" excess transport material from the textile substrate to thereby "dry" the textile substrate. Increasing the temperature of the bath can serve to improve the speed and efficiency of the drying step. In the case that this step is not sufficient for complete removal of excess transport material, it can be augmented by conventional mechanical and/or thermal methods either within the dyeing/treatment vessel or in another piece of process equipment. That is, drying of the textile substrate can be performed via centrifuging, vacuum extraction, dielectric heating or convection heating either in situ or in external equipment. The dyeing/treatment process is completed by depressurizing the dyeing/treatment system to a recovery system where a separator removes any trace contaminants from the $CO_2$ before sending it to storage.

III. Laboratory Examples

The following Laboratory Examples have been included to illustrate preferred modes of the invention. Certain aspects of the following Laboratory Examples are described in terms of techniques and procedures found or contemplated by the present inventors to work well in the practice of the invention. These Laboratory Examples are exemplified through the use of standard laboratory practices of the inventors. In light of the present disclosure and the general level of skill in the art, those of skill will appreciate that the following Laboratory Examples are intended to be exemplary only and that numerous changes, modifications and alterations can be employed without departing from the spirit and scope of the invention.

To summarize, the Laboratory Examples indicate that acid dyes on nylon; basic dyes on acrylic; direct dyes on cotton, Arnel, silk, viscose rayon; disperse dyes on polyester; finishes on any substrate (softener, antistatic, lubricants, etc); preparation (scouring, bleaching chemistry); and disperse/direct dye combinations on polyester/cotton blends and other blends like nylon/cotton (popular in knit underwear fabrics) can be employed in the process of the present invention.

In each of the following Laboratory Examples, a package dyeing SCF—$CO_2$ system was employed. A representative embodiment of such a system is disclosed in U. S. Pat. No. 6,048,369, issued Apr. 11, 2000 to Smith, et al., herein incorporated by reference in its entirety. Other representative systems are disclosed in U.S. Pat. Nos. 5,298,032; 5,518,088; and 6,010,542; and the contents of each of these patents are incorporated herein by reference in their entirety. In each of the following Laboratory Examples, $CO_2$ density was about 0.6 g/mL, flow was about 7 gallons bath fluid/lb substrate/minute; and temperature was about 80–100° C. (usually 90° C.). Pressure ranged from about 1,500 to about 5,000 psi, and preferably ranged from about 3,000 to about 4,000 psi. Thus, pressure can vary and can be optionally lowered.

Laboratory Example 1

| Laboratory Example 1 Dyeing of Cotton | |
|---|---|
| Yarn: | Cotton (not prepared, unfinished) |
| Package Density: | 0.5 g/cc (approx.) |
| Dye: | C.I. Direct Blue 78 |
| Weight of Yarn: | 450 g (approx.) |
| Weight of Dye: | 10 g |
| % o.w.g.: | 2.2% |
| Nominal Dyeing Conditions: | |
| $CO_2$ Density: | 0.6 g/cc |
| Temperature: | 40–83° C. |
| Volume Flow Rate: | 7 gallons per minute (gpm) |
| Unit Volume Flow Rate: | 7 gal/min-lb |
| Flow Reversal: | 5 min Inside-to-outside (I-O) Flow<br>5 min Outside-to-inside (O-I) Flow |

Dyeing Procedure: Wet out yarn package thoroughly; load package and dye into SCF—$CO_2$ dyeing machine; fill machine to $CO_2$ density of about 0.6 g/cc at ambient temperature; circulate at about 7 gpm volume flow rate with 5 min./5 min. I–O/O–I flow reversal pattern; heat to 80° C.; circulate at 80° C. for 30 minutes; depressurize.

Results: A dark blue colorfast dyeing was obtained; a stocking was knitted from the dyed yarn and evaluated for shade depth and crocking; the stocking had a color matching Munsell designation 2.5 PB 2/6; a dry crocking of grade 4–5 and a wet crocking of grade 3–4 were obtained for the stocking (AATCC Standard Test Method #8); the tensile strength and elongation of the dyed yarn were measured by the Single Strand Method (ASTM D2256-97) and found to be comparable to values for a sample of undyed yarn, i.e. undyed: T.S.=68 g, % Elongation=3.93; dyed: T.S.=553 g, % Elongation=4.69.

The observed data fell within normal parameters for this dye on unprepared, "unfinished" cotton (unfinished means that the cotton had not yet received any resin treatment for shrinkage control, etc.). The approach of this Example is equally applicable to "prepared" cotton that has been scoured and/or bleached.

Laboratory Example 2

| Dyeing of Wool | |
|---|---|
| Package: | Cotton (served to hold fabric for dying) |
| Fabric: | Worsted Wool (woven, natural state; unscoured, unbleached) |
| Dye: | C.I. Acid Red 360 |
| Weight of Fabric: | 40 g (est.) |
| Weight of Dye: | 2 g |
| % o.w.g.: | 5% |
| Nominal Dyeing Conditions: | |
| CO2 Density: | 0.7 g/cc |
| Temperature: | 75° C. |
| Volume Flow Rate: | 7 gpm |
| Flow Reverseral: | Outside-to-inside (O-I) flow over entire cycle |

Dyeing Procedure: Wet out yarn package; wet wool fabric swatches; wrap and secure fabric swatches to outside of yarn package; load dye and package with swatches into SCF—$CO_2$ dyeing machine; fill machine to $CO_2$ density of about 0.7 g/cc at ambient temperature; circulate O–I at about 7 gpm volume flow rate and heat to 80° C.; circulate at 80° C. for 30 minutes; depressurize.

Results: A dark red colorfast dyeing was obtained; the dyed fabric was evaluated for shade depth and crocking; the fabric had a color matching Munsell designation 2.5 R 2/8; wet and dry crocking were both of grade 4 determined by AATCC Standard Test Method #8; the breaking strength and elongation of the dyed fabric were measured (Fabric Grab/Strip Test, ASTM D5034/5035) and compared to values determined for a sample of undyed fabric; the results are shown in Table 3 below.

TABLE 3

| Fabric | Direction | Breaking Strength (g) | Elongation (%) |
|---|---|---|---|
| Undyed Wool | warp | 33.8 | 18.6 |
| Dyed Wool | warp | 34.7 | 22.3 |
| Undyed Wool | fill | 17.0 | 11.7 |
| Dyed Wool | fill | 16.4 | 19.3 |

All of the above results are considered normal for the noted dye on wool in its natural state.

In the wool dyeings, two runs were performed, one with and one without surfactant to help the wetting. This is an optional step, and it appeared to contribute to levelness. The approach of this Example is equally applicable to "prepared" wool that has been scoured and/or bleached.

Laboratory Example 3

| Dyeing of Nylon | |
|---|---|
| Package: | Polyester (serves to hold fabric for dying) |
| Fabric: | Nylon 6,6 (woven) |
| Dye: | C.I. Acid Red 360 |
| Weight of Fabric: | 40 g (est.) |
| Weight of Dye: | 2 g |
| % o.w.g.: | 5% |
| Nominal Dyeing Conditions: | |
| CO2 Density: | 0.65 g/cc |
| Temperature: | 100° C. |
| Volume Flow Rate: | 7 gpm |
| Flow Reversal: | Outside-to-inside (O-I) flow over entire cycle |

Dyeing Procedure: Wet out polyester yarn package thoroughly; wet nylon fabric swatches; wrap and secure swatches to outside of yarn package; load dye and package with swatches into SCF—$CO_2$ dyeing machine; fill machine to $CO_2$ density of about 0.65 g/cc at ambient temperature; circulate O–I at maximum volume flow rate and heat to 100° C.; circulate 30 minutes; depressurize.

Results: A dark red colorfast dyeing was obtained; the dyed fabric was evaluated for shade depth and crocking; the stocking had a color matching Munsell designation 5 R 2/8; wet and dry crocking were both of grade 4 determined by AATCC Standard Test Method #8; the breaking strength and elongation of the dyed fabric were measured (Fabric Grab/Strip Test, ASTM D5034/5035) and compared to values determined for a sample of undyed fabric; the results are shown in Table 4 below.

TABLE 4

| Fabric | Direction | Breaking Strength (g) | Elongation (%) |
|---|---|---|---|
| Undyed Nylon | warp | 122.5 | 35.4 |
| Dyed Nylon | warp | 119.0 | 52.7 |
| Undyed Nylon | fill | 49.5 | 29.4 |
| Dyed Nylon | fill | 58.1 | 32.8 |

All of these data fall with normal parameters for this dye on nylon. The approach of this Example is equally applicable to "prepared" nylon that has been scoured and/or bleached.

Laboratory Example 4

| Dyeing of Orlon 75 Acrylic | |
|---|---|
| Package: | Polyester (serves to hold fabric for dying) |
| Fabric: | Acrylic (ORLON ® 75) |
| Dye: | C.I. Basic Blue 38 |
| Weight of Fabric: | 40 g (est.) |
| Weight of Dye: | 2 g |
| % o.w.g.: | 5% |
| Nominal Dyeing Conditions: | |
| CO2 Density: | 0.65 g/cc |
| Temperature: | 100° C. |
| Volume Flow Rate: | 7 gpm |
| Flow Reversal: | Outside-to-inside (O-I) flow over entire cycle |

Dyeing Procedure: Wet out polyester yarn package thoroughly; wet acrylic fabric swatches; wrap and secure swatches to outside of yarn package; load dye and package with swatches into SCF—$CO_2$ dyeing machine; fill machine to $CO_2$ density of about 0.65 g/cc at ambient temperature; circulate O–I at maximum volume flow rate and heat to 100° C.; circulate 30 minutes; depressurize.

Results: A dark red colorfast dyeing was obtained; the dyed fabric was evaluated for shade depth and crocking; the stocking had a color matching Munsell designation 2.5 PB 3/8; wet and dry crocking were both of grade 5 determined by AATCC Standard Test Method #8; the breaking strength and elongation of the dyed fabric were measured (Fabric Grab/Strip Test, ASTM D5034/5035) and compared to values determined for a sample of undyed fabric; the results are shown in Table 5 below.

TABLE 5

| Fabric | Direction | Breaking Strength [g] | Elongation (%) |
|---|---|---|---|
| Undyed Acrylic | warp | 91.1 | 34.2 |
| Dyed Acrylic | warp | 83.7 | 43.3 |
| Undyed Acrylic | fill | 68.8 | 33.7 |
| Dyed Acrylic | fill | 71.2 | 40.3 |

All of the above results are considered normal for this dye on acrylic fabric.

Laboratory Example 5

Dyeing of Polyester

This Example pertains to the dyeing of polyester with a disperse dye. The polyester comprises DACRON®54, DACRON®64 and DACRON®107W fibers (E.I. du Pont de Nemours & Co., Wilmington, Del.).

Package: polyester (filament)
Package Density: 0.5 g/cc (approx.)
Dye: C.I. Disperse Blue 56 (paste)
Weight of Yarn: 450 g (est.)
Weight of Dye: 4 g
% o.w.g.: 0.89%
Nominal Dyeing Conditions:
$CO_2$ Density: 0.6 g/cc
Temperature: 100° C.
Volume Flow Rate: 15 gpm
Unit Volume Flow Rate: 15 gal/min-lb
Flow Reversal: 5 min inside-to-outside (I–O) flow, 5 min outside-to-inside (O–I) flow Dyeing Procedure: Wet out yarn package thoroughly; load dye and package into SCF—$CO_2$ dyeing machine; fill machine to $CO_2$ density of about 0.6 g/cc at ambient temperature; circulate at about 15 gpm volume flow rate with 5 min./5 min. I–O/O–I flow reversal pattern; heat to 100° C.; circulate at 100° C. for 30 minutes; depressurize.

Results: A dark blue colorfast dyeing was obtained; a stocking was knitted from the dyed yarn; no apparent crocking was noted for the dyeing; quantitative evaluation of shade depth and crocking was not performed; the tensile strength of the dyed yarn was measured by the Single Strand Method (ASTM D2256-97) and found to be comparable to that for a sample of undyed yarn; Undyed yarn T.S.=132 g; Dyed yarn T.S.=127 g; all of these results are considered normal for the trial dye on filament polyester yarn.

Laboratory Example 6

| Dyeing of a Blended Textile Substrate | |
|---|---|
| Package: | Polyester/Cotton (50/50 Blend) |
| Package Density: | 0.4 g/cc (approx.) |
| Dye: | C.I. Disperse Blue 56 (paste), C.I. Direct Blue 78 |
| Weight of Yarn: | 225 g (est.) |
| Weight of Dye: | 5 g (Total of equal amounts of the two dyes) |
| % o.w.g.: | 2.22% |
| Nominal Dyeing Conditions: | |
| CO2 Density: | 0.33 g/cc |
| Temperature: | 100° C. |
| Volume Flow Rate: | 7 gpm |
| Unit Volume Flow Rate: | 7 gal/min-lb |
| Flow Reversal: | 5 min inside-to-outside (I-O) flow, 5 min outside-to-inside (O-I) flow |

Dyeing Procedure: Wet out yarn package thoroughly; load dye and package into SCF—$CO_2$ dyeing machine; fill machine to $CO_2$ density of about 0.6 g/cc at ambient temperature; circulate at 7 gpm volume flow rate with 5 min./5 min. I–O/O–I flow reversal pattern; heat to 100° C.; circulate at 100° C. for 30 minutes; depressurize.

Results: A dark blue colorfast dyeing was obtained; a stocking was knitted from the dyed yarn and evaluated for shade depth and crocking; the shade depth of the stocking was found to correspond to approximately a 3% dyeing based on reflectance measurements; a dry crocking of grade 4–5 and wet crocking of grade 4 were obtained for the stocking using AATCC Standard Test Method #8; the tensile strength of the dyed yarn was measured by the Single Strand Method (ASTM D2256-97) and found to be comparable to that for a sample of undyed yarn; Undyed yarn T.S.=67 g; Dyed yarn T.S.=72 g; all of these results are considered normal for this dye combination on polyester/cotton yarn.

Laboratory Example 7

Treatment of a Textile Substrate with Softener

This Example pertains to the treatment of a 100 percent cotton twill textile substrate with a softener. The purpose of the softener is to make the textile substrate feel slicker and softer, and to increase the tearing strength of the textile substrate.

| | |
|---|---|
| Package: | Cotton (serves to hold fabric for application of softener) |
| Fabric: | Cotton (bleached)<br>Cotton (unbleached) |
| Softener: | Cationic (5 parts) and HDPE (5 parts) mixed in water (10 parts) |
| Weight of Fabric: | 40 g (est.) |
| Weight of Softener: | 5 g |
| % o.w.g.: | 12.5% |
| Nominal Treatment Conditions: | |
| $CO_2$ Density: | 0.3 g/cc |
| Temperature: | 50° C. |
| Volume Flow Rate: | 15 gpm |
| Flow Reversal: | Outside-to-inside (O–I) flow over entire cycle |

Treatment Procedure: Wet out cotton yarn package thoroughly; wet cotton fabric swatches; wrap and secure swatches to outside of yarn package; load softener and package with swatches into SCF—$CO_2$ dyeing machine; fill machine to $CO_2$ density of about 0.3 g/cc at ambient temperature; circulate outside-to-inside at circulate at about 160 gpm volume flow rate; heat to 50° C.; circulate at 50° C. for 30 minutes; isolate treatment vessel and depressurize.

Results: The treated fabric felt slicker and softer relative to cotton that had not been treated with softener; the tearing strength of the treated fabric was measured and found to be 6.3 pounds; the tearing strength of an untreated fabric sample was measure and found to be 4.4 pounds; therefore, the addition of softener resulted in a tearing strength increase of 43%; these results are considered normal for this softener on cotton fabric.

It will be understood that various details of the invention can be changed without departing from the scope of the invention. Furthermore, the foregoing description is for the purpose of illustration only, and not for the purpose of limitation—the invention being defined by the claims.

What is claimed is:

1. A process for treating a textile substrate, the process comprising:

(a) providing a textile substrate;

(b) providing a treatment bath fluid:

(c) entraining a transport material in the treatment bath fluid wherein the transport material further comprises a treatment material dissolved or suspended therein and wherein the transport material is substantially immiscible with the treatment bath fluid; and (d) contacting the textile substrate with the transport material entrained the treatment bath fluid to deliver the treatment material to the textile substrate and thereby treat the textile substrate with the treatment material in the transport material.

2. The process of claim 1, wherein the textile substrate comprises a hydrophilic fiber, a hydrophobic fiber, or a blend thereof.

3. The process of claim 2, wherein the hydrophilic fiber comprises a cellulosic fiber, a silk fiber, a wool fiber or a blend thereof.

4. The process of claim 3, wherein the cellulosic fiber is a cotton fiber.

5. The process of claim 1, wherein the treatment bath fluid comprises near critical liquid carbon dioxide, supercritical fluid carbon dioxide or combination thereof.

6. The process of claim 1, wherein the transport material comprises water.

7. The process of claim 1, wherein the transport material is present in a trace amount.

8. The process of claim 1, wherein the treatment material comprises a dye, a bleach, an optical brightener, a softener, an anti-static agent, a lubricant, a scouring agent a sizing agent, an ultraviolet stabilizing agent, an antimicrobial agent, or combinations thereof.

9. The process of claim 1, wherein the treatment bath fluid is free of a surfactant that is soluble in the treatment bath fluid.

10. The process of claim 1, further comprising drying the textile substrate by removing the transport material from the textile substrate.

11. The process of claim 10, wherein the step of drying the textile substrate further comprises circulating the treatment bath fluid through the textile substrate to re-entrain the transport material in the treatment barn fluid, thereby removing transport material from the textile substrate.

12. A process for treating a textile substrate in a near critical liquid or supercritical fluid carbon dioxide treatment bath fluid,, the process comprising:

(a) providing a textile substrate;

(b) providing a treatment bath fluid comprising near critical liquid carbon dioxide, supercritical fluid carbon dioxide or combinations thereof;

(c) entraining a transport material in the treatment bath fluid wherein the transport material further comprises a treatment material dissolved or suspended therein and wherein the transport material is substantially immiscible with the treatment bath fluid; and (d) contacting the textile substrate with the transport material entrained in the treatment bath fluid to deliver the treatment material to the textile substrate and thereby treat the textile substrate with the treatment material dissolved or suspended in the transport material.

13. The process of claim 12, wherein the textile substrate comprises a hydrophilic fiber, a hydrophobic fiber, or a blend thereof.

14. The process of claim 13, wherein the hydrophilic fiber comprises a cellulosic fiber, a silk fiber, a wool fiber or a blend thereof.

15. The process of claim 14, wherein the cellulosic fiber is a cotton fiber.

16. The process of claim 12, wherein the transport material comprises water.

17. The process of claim 12, wherein the transport material is present in a trace amount.

18. The process of claim 12, wherein the treatment material comprises a dye, a bleach, an optical brightener, a softener, an anti-static agent, a lubricant, a scouring agent, a sizing agent, an ultraviolet stabilizing agent, an antimicrobial agent, or blends thereof.

19. The process of claim 12, wherein the treatment bath fluid is free of a surfactant that is soluble in the treatment bath fluid.

20. The process of claim 12, further comprising drying the textile substrate by removing the transport material from the textile substrate.

21. The process of claim 20, wherein the step of drying the textile substrate further comprises circulating the treatment bath fluid through the textile substrate to re-entrain the transport material in the treatment bath fluid, thereby removing transport material from the textile substrate.

22. A process for treating a hydrophilic textile substrate in a near critical liquid or supercritical fluid carbon dioxide treatment bath fluid, the process comprising:

(a) providing a hydrophilic textile substrate;

(b) providing a treatment bath fluid comprising near critical liquid carbon dioxide, supercritical fluid carbon dioxide or blends thereof;

(c) entraining a transport material in the treatment bath fluid wherein the transport material further comprises a treatment material dissolved or suspended therein and wherein the transport material is substantially immiscible with the treatment bath fluid; and (d) contacting the textile substrate with the transport material entrained in the treatment bath fluid to deliver the treatment material to the textile substrate and thereby treat the textile substrate with the treatment material dissolved or suspended in the transport material.

23. The process of claim 22, wherein the hydrophilic fiber comprises a cellulosic fiber, a silk fiber, a wool fiber or blends thereof.

24. The process of claim 23, wherein the cellulosic fiber is a cotton fiber.

25. The process of claim 22, wherein the transport material comprises water.

26. The process of claim 22, wherein the transport material is present in a trace amount.

27. The process of claim 22, wherein the treatment material comprises a dye, a bleach, an optical brightener, a softener, an anti-static agent, a lubricant, a scouring agent, a sizing agent, an ultraviolet stabilizing agent, an antimicrobial agent, or blends thereof.

28. The process of claim 22, wherein the treatment bath fluid is free of a surfactant that is soluble in the treatment bath fluid.

29. The process of claim 22, further comprising drying the textile substrate by removing the transport material from the textile substrate.

30. The process of claim 29, wherein the step of drying the textile substrate further comprises circulating the treatment bath fluid through the textile substrate to re-entrain the transport material in the treatment bath fluid, thereby removing transport material from the textile substrate.

31. A process for treating a hydrophobic textile substrate in a near critical liquid or supercritical fluid carbon dioxide treatment bath fluid, the process comprising:

(a) providing a hydrophobic textile substrate;

(b) providing a treatment bath fluid comprising near critical liquid carbon dioxide, supercritical fluid carbon dioxide or combinations thereof;

(c) entwining a transport material in the treatment bath fluid wherein the transport material further comprises a treatment material dissolved or suspended therein and wherein the transport material is substantially immiscible with the treatment bath fluid; and (d) contacting the hydrophobic textile substrate with the transport material entrained in the treatment bath fluid to deliver the treatment material to the textile substrate and thereby treat the textile substrate with the treatment material dissolved or suspended in the transport material.

32. The process of claim 31, wherein the transport material comprises water.

33. The process of claim 31, wherein the treatment material comprises a dye, a bleach, an optical brightener, a softener, an anti-static agent, a lubricant, a scouring agent, a sizing agent, an ultraviolet stabilizing agent, an antimicrobial agent, or combinations thereof.

34. The process of claim 31, wherein the treatment bath fluid is free of a surfactant that is soluble in the treatment bath fluid.

35. The process of claim 31, further comprising drying the textile substrate by removing the transport material from the textile substrate.

36. The process of claim 35, wherein the step of dying the textile substrate further comprises circulating the treatment bath fluid through the textile substrate to re-entrain the transport material in the treatment bath fluid, thereby removing transport material from the textile substrate.

37. The process of claim 1, wherein the transport material is entrained in the treatment bath fluid in droplets.

38. A process for treating a textile substrate, the process comprising:

(a) providing a textile substrate;

(b) providing a treatment bath fluid;

(c) entraining a transport material in the treatment bath fluid wherein the transport material further comprises a treatment material dissolved or suspended therein and wherein the transport material is substantially immiscible with the treatment bath fluid; and (d) contacting the textile substrate with the transport material in the treatment bath fluid to thereby treat the textile substrate with the treatment material in the transport material, wherein the transport material is entrained in the treatment bath fluid in droplets by one of atomizing and sparging.

39. The process of claim 12, wherein the transport material is entrained in the treatment bath fluid in droplets.

40. A process for treating a textile substrate in a near critical liquid or supercritical fluid carbon dioxide treatment bath fluid, the process comprising:

(a) providing a textile substrate;

(b) providing a treatment bath fluid comprising near critical liquid carbon dioxide, supercritical fluid carbon dioxide or combinations thereof;

(c) entraining a transport material in the treatment barn fluid wherein the transport material further comprises a treatment material dissolved or suspended therein and wherein the transport material is substantially immiscible with the treatment bath fluid; and (d) contacting the textile substrate with the transport material in the treatment bath fluid to thereby treat the textile substrate with the treatment material dissolved or suspended in the transport material, wherein the transport material is entrained in the treatment bath fluid in droplets by one of atomizing and sparging.

41. The process of claim 22, wherein the transport material is entrained in the treatment bath fluid in droplets.

42. A process for treating a hydrophobic textile substrate in a near critical liquid or supercritical fluid carbon dioxide treatment bath fluid, the process comprising:

(a) providing a hydrophobic textile substrate;

(b) providing a treatment bath fluid comprising near critical liquid carbon dioxide, supercritical fluid carbon dioxide or combinations thereof;

(c) entraining a transport material in the treatment bath fluid wherein the transport material further comprises a treatment material dissolved or suspended therein and wherein the transport material is substantially immiscible with the treatment bath fluid; and (d) contacting the textile substrate with the transport material in the treatment bath fluid to thereby treat the textile substrate with the treatment material dissolved or susoended in the transDort material, wherein the transport material is entrained in the treatment bath fluid in droplets by one of atomizing and sparging.

43. The process of claim 31, wherein the transport material is entrained in the treatment bath fluid in droplets.

44. A process for treating a hydrophobic textile substrate in a near critical liquid or supercritical fluid carbon dioxide treatment bath fluid, the process comprising:

(a) providing a hydrophobic textile substrate;

(b) providing a treatment bath fluid comprising near critical liquid carbon dioxide, supercritical fluid carbon dioxide or combinations thereof;

(c) entraining a transport material in the treatment bath fluid wherein the transport material further comprises a treatment material dissolved or suspended therein and wherein the transport material is substantially immiscible with the treatment bath fluid; and (d) contacting the hydrophobic textile substrate with the transport material in the treatment bath fluid to thereby treat the textile substrate with the treatment material dissolved or suspended in the transport material, wherein the transport material is entrained in the treatment bath fluid in droplets by one of atomizing and sparging.

* * * * *